US008727875B2

(12) United States Patent
Lundback et al.

(10) Patent No.: US 8,727,875 B2
(45) **Date of Patent: *May 20, 2014**

(54) AUTOMATED ENHANCEMENTS FOR BILLIARDS AND THE LIKE

(75) Inventors: Niklas Lundback, San Francisco, CA (US); Steve Mason, San Francisco, CA (US); Michael Harville, Palo Alto, CA (US); Nikolai Cornell, San Francisco, CA (US); Travis Threlkel, San Francisco, CA (US)

(73) Assignee: Obscura Digital, Inc., San Francisco, CA (US)

( * ) Notice: Subject to any disclaimer, the term of this patent is extended or adjusted under 35 U.S.C. 154(b) by 1115 days.

This patent is subject to a terminal disclaimer.

(21) Appl. No.: 12/510,247

(22) Filed: Jul. 27, 2009

(65) Prior Publication Data

US 2011/0021256 A1 Jan. 27, 2011

(51) Int. Cl.
*A63F 9/24* (2006.01)

(52) U.S. Cl.
USPC ..... 463/31; 463/1; 463/30; 463/33; 463/34; 463/35; 473/1; 473/2; 473/4; 473/23

(58) Field of Classification Search
USPC ..... 463/1, 2, 4, 31, 30, 33–35; 473/1, 2; 273/118 R; 702/150
See application file for complete search history.

(56) References Cited

U.S. PATENT DOCUMENTS 4,882,676 A * 11/1989 Van De Kop et al. ..... 473/2
5,026,053 A * 6/1991 Paterson et al. ..... 473/23
5,135,218 A 8/1992 McGovern
5,534,917 A 7/1996 MacDougall
5,564,698 A * 10/1996 Honey et al. ..... 473/570
5,850,352 A 12/1998 Moezzi
6,244,970 B1 6/2001 Sullivan
6,482,086 B1 * 11/2002 Rimoto et al. ..... 463/1
6,766,036 B1 * 7/2004 Pryor ..... 382/103
6,827,651 B1 12/2004 Davis
7,063,620 B2 6/2006 Nearhood
7,118,486 B2 * 10/2006 Evers ..... 473/2
7,170,492 B2 1/2007 Bell
7,227,611 B2 6/2007 Hull
7,259,747 B2 8/2007 Bell (Continued)

FOREIGN PATENT DOCUMENTS

DE 4039315 A1 6/1992
JP 2002186702 A 7/2002

(Continued)

OTHER PUBLICATIONS

Leckie, W. and Greenspan, M. An event-based pool physics simulator. In: Lecture Notes in Computer Science, vol. 4250. Springer-Verlag, pp. 247-262 (2006).

(Continued)

*Primary Examiner* — David L Lewis
*Assistant Examiner* — Chase Leichliter
(74) *Attorney, Agent, or Firm* — Edouard Garcia

(57) ABSTRACT

Position data is generated. The position data describes real-time positions of each of one or more billiard balls moving on a playing surface of a billiard table. Imagery is displayed on the playing surface. The imagery dynamically responds to the position data as the one or more billiard balls move on the playing surface.

44 Claims, 6 Drawing Sheets

(56) References Cited

U.S. PATENT DOCUMENTS

| | | | | |
|---|---|---|---|---|
| 7,348,963 | B2 | 3/2008 | Bell | |
| 7,358,861 | B2 | 4/2008 | Blum | |
| 7,850,535 | B2 * | 12/2010 | Noble et al. | 473/140 |
| 7,885,784 | B2 * | 2/2011 | Frank et al. | 702/150 |
| 8,144,118 | B2 * | 3/2012 | Hildreth | 345/156 |
| 2004/0102247 | A1 * | 5/2004 | Smoot et al. | 463/36 |
| 2004/0127283 | A1 | 7/2004 | Martin | |
| 2004/0157671 | A1 | 8/2004 | Maurer | |
| 2004/0183775 | A1 | 9/2004 | Bell | |
| 2005/0064936 | A1 * | 3/2005 | Pryor | 463/36 |
| 2005/0209013 | A1 | 9/2005 | Davis | |
| 2006/0139314 | A1 * | 6/2006 | Bell | 345/156 |
| 2006/0149495 | A1 * | 7/2006 | Mazalek et al. | 702/150 |
| 2006/0192852 | A1 | 8/2006 | Rosenthal | |
| 2008/0062123 | A1 | 3/2008 | Bell | |
| 2008/0111310 | A1 * | 5/2008 | Parvanta | 273/309 |
| 2008/0191864 | A1 * | 8/2008 | Wolfson | 340/524 |
| 2009/0029754 | A1 * | 1/2009 | Slocum et al. | 463/5 |
| 2009/0061971 | A1 | 3/2009 | Weitzner | |
| 2009/0062002 | A1 * | 3/2009 | Kotlarik et al. | 463/33 |
| 2009/0115721 | A1 | 5/2009 | Aull | |
| 2009/0233697 | A1 * | 9/2009 | Bennett | 463/25 |
| 2010/0178994 | A1 * | 7/2010 | Do et al. | 473/2 |
| 2011/0053688 | A1 * | 3/2011 | Crawford et al. | 463/31 |
| 2011/0237367 | A1 * | 9/2011 | Kodama et al. | 473/570 |

FOREIGN PATENT DOCUMENTS

| | | | | |
|---|---|---|---|---|
| JP | 2006043017 | A | 2/2006 | |
| JP | 2008-275984 | * | 10/2008 | A63B 43/00 |
| KR | 10-2000-0006689 | | 2/2000 | |
| KR | 20080100861 | A | 11/2008 | |
| KR | 20090013980 | A | 2/2009 | |
| KR | 20090074127 | A | 7/2009 | |

OTHER PUBLICATIONS

Andreas Sundquist, "Dynamic line integral convolution for visualizing streamline evolution", IEEE Transactions on Visualization and Computer Graphics, vol. 9, No. 3, Jul./Sep. 2003.

Aaron Hertzmann, "Painterly Rendering with Curved Brush Strokes of Multiple Sizes,", SIGGRAPH 98 Conference Proceedings., Jul. 1998., pp. 453-460.

Engadget, "Digitall Assisted Billiards makes everyone a pool shark," posted Dec. 11, 2009, 7 pages, http://www.engadget.com/2008/12/11/digitally-assisted-billiards-makes-everyone-a-pool-shark/.

Justin Needham and Matthew Straub, "Digitally Assisted Billiards," 2 pages, downloaded Jun. 25, 2009, http://www.prism.gatech.edu/~gtg279x/Digitally_Assisted_Billards/Welcome.html.

Technorati, "Digitally assisted billiards," 2 pages, downloaded Jun. 25, 2009, http://technorati.com/posts/VTvDdkjayd051X7XZn342cPtQpTyDFbnWeF%2B8HNHIXQ%3D.

Chiba, et.al., "Two-dimensional visual simulation of flames, smoke and the spread of fire", Journal of Visualization and Computer Animation, vol. 5, No. 1, pp. 37-53.

Michael E. Goss, "Motion Simulation: A Real Time Particle System for Display of Ship Wakes," IEEE Computer Graphics and Applications, vol. 10, No. 3, pp. 30-35, May/Jun. 1990.

Kass and Miller, "Rapid, stable fluid dynamics for computer graphics", in ACM SIGGRAPH Computer Graphics vol. 24, No. 4, Aug. 1990.

M. Harville, "Stereo person tracking with short and long term plan-view appearance models of shape and color," Proceedings of the IEEE International Conference on Advanced Video and Signal based Surveillance, pp. 522-527, Como, Italy, Sep. 2005.

Search Report and Written Opinion issued in counterpart International Application No. PCT/US2010/042060 (mailed Feb. 24, 2011).

Supplementary European Search Report issued in European Patent Application No. 10806816.4, 6 pages (dated Dec. 11, 2012).

* cited by examiner

AUTOMATED ENHANCEMENTS FOR BILLIARDS AND THE LIKE

BACKGROUND

Billiards (also referred to as "cue sports") encompasses a variety of different games, including, but not limited to, three ball, eight ball, nine ball, snooker, and any other type of game played on a rectangular or other geometric shaped table with a playing surface bounded by raised sides, in which a cue stick is used to hit a ball (e.g., a cue ball) against another ball or the sides of the table. The table typically is cloth-covered and the edges typically are cushioned (e.g., with rubber and the like).

A variety of devices and systems have been developed for the purpose of enhancing the game of billiards. For example, a number of training aids have been developed to assist players in making shots. In one example, a cue stick has a laser that is aligned with the longitudinal axis of the cue stick. The laser generates a laser beam that can be aligned with the intended initial cue ball path. The laser may be used in combination with reflectors that are attached to the side cushions of the table to assist in predicting how the cue ball will rebound off the cushions. Another exemplary training system includes a camera, a controller, and a projector. The camera captures images of the playing surface of a billiard table. The controller determines the locations of the balls on the table and the current angle of the cue, and predicts the expected trajectory the shot based on the locations of the balls and the current angle of the cue. The projector visually displays a glowing blue line showing where each ball would go and where the collisions would occur if the shot were taken.

Additional enhancements for billiards and the like are desirable, particularly with respect to making the games more entertaining.

SUMMARY

In one aspect, the invention features a method in accordance with which position data is generated. The position data describes real-time positions of each of one or more billiard balls moving on a playing surface of a billiard table. Imagery is displayed on the playing surface. The imagery dynamically responds to the position data as the one or more billiard balls move on the playing surface.

The invention also features apparatus operable to implement the method described above and computer-readable media storing computer-readable instructions causing a computer to implement the method described above.

DETAILED DESCRIPTION

Figure 1:
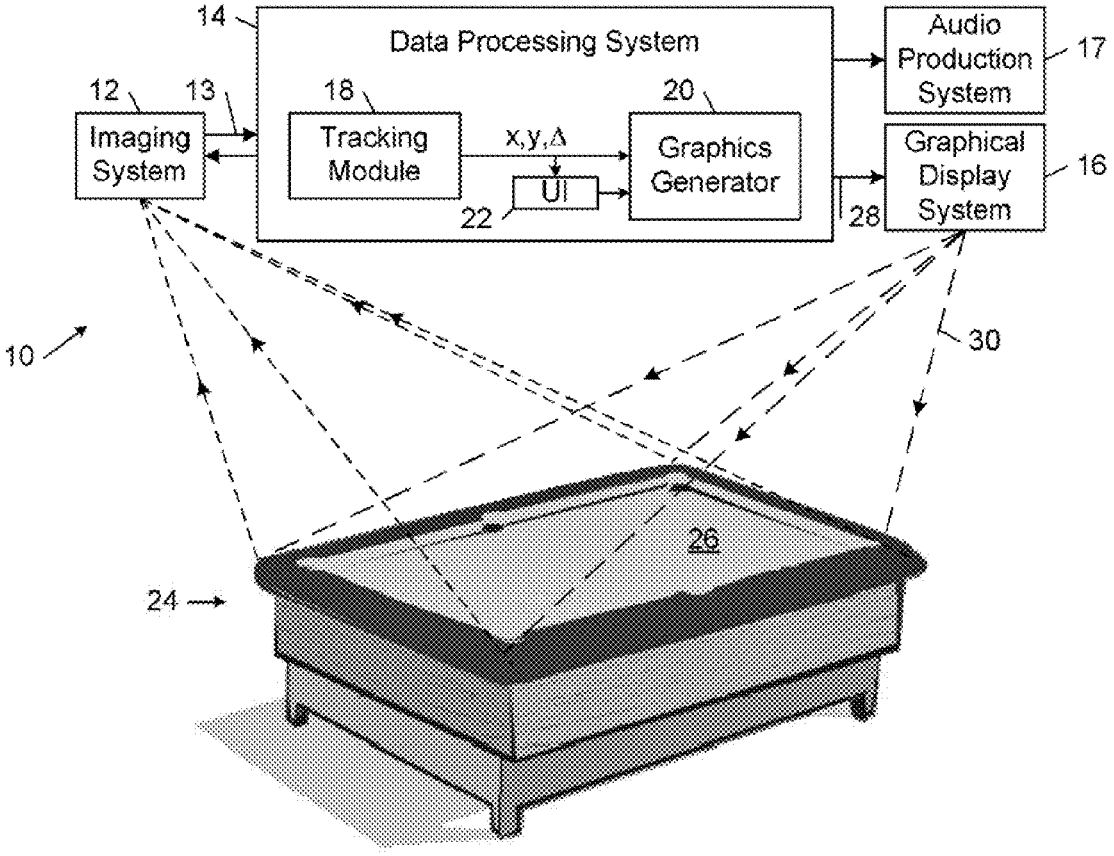
FIG. 1 is a diagrammatic view of an embodiment of an automated enhancement generation system and a billiard table.

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. DEFINITION OF TERMS

The term "pixel" refers to an addressable region of an image. Each pixel has at least one respective value that is represented by one or more bits. For example, a pixel in the RGB color space includes a respective value for each of the colors red, green, and blue, where each of the values may be represented by one or more bits.

A "computer" is any machine, device, or apparatus that processes data according to computer-readable instructions that are stored on a computer-readable medium either temporarily or permanently. A "software application" (also referred to as software, an application, computer software, a computer application, a program, and a computer program) is a set of instructions that a computer can interpret and execute to perform one or more specific tasks. A "data file" is a block of information that durably stores data for use by a software application.

The term "machine-readable medium" refers to any medium capable carrying information that is readable by a machine (e.g., a computer). Storage devices suitable for tangibly embodying these instructions and data include, but are not limited to, all forms of non-volatile computer-readable memory, including, for example, semiconductor memory devices, such as EPROM, EEPROM, and Flash memory devices, magnetic disks such as internal hard disks and removable hard disks, magneto-optical disks, DVD-ROM/RAM, and CD-ROM/RAM.

The term "imagery" means one or more images that can be displayed by a display apparatus. Exemplary types of imagery include static images and video images. In general, imagery can include any type of visually perceptible stimulus, including, for example, natural images of real scenes, computer-modified versions of natural images, synthetic computer-generated photorealistic and non-photorealistic images, monochromatic images, multi-color images, and images that consist of monochromatic light of uniform intensity.

The term "displaying" means causing one or more images to be visually perceptible.

The term "identifying" means establishing the identity or taxonomic position of.

The term "billiard game object" refers to an object that is used by a player in the course of playing a game of billiards. Exemplary types of billiard game objects include a billiard ball, a cue stick, a billiard ball rack (or simply "rack"), a cue tip chalk, a billiards bridge, a table brush, and specially designed objects for use with customized billiards tables and game systems.

A "predicate" is a conditional part of a rule.

As used herein, the term "includes" means includes but not limited to, the term "including" means including but not limited to. The term "based on" means based at least in part on.

II. INTRODUCTION

The embodiments that are described herein provide apparatus and methods that automatically detect game objects (e.g., billiard balls, cue sticks, a billiard rack, and cue tip chalk) and respond to the detected game objects in one or more ways that enhance a player's experience with the game in its current context.

Some embodiments track real-time positions of each of one or more billiard game objects on a playing surface of a billiard table, and display on the billiard table images that dynamically respond to the tracked real-time positions of the one or more billiard game objects. The images can provide a variety of different dynamic and static visual effects that enhance players' experiences with billiards and the like. Audio effects corresponding to the tracked real-time positions of the one or more billiard game objects, or complementing the visual effects being displayed, may also be produced.

Some embodiments are capable of inferring a state of a billiards game that is being played based on position data describing a respective current position of each of one or more billiard game objects in relation to a billiard table. These embodiments are able to select one or more perceptible effects associated with the determined state of the billiard game, and automatically produce the one or more perceptible effects in connection with the billiards game.

Some embodiments interface players with a machine. In these embodiments, position data is generated. The position data describes a respective current position of each of one or more game objects in relation to a playing surface defining a boundary of a field of play of a game involving use of the one or more game objects in the field of play. A determination is made as to whether the position data satisfies an input instruction predicate. In response to a determination that the position data satisfies the input instruction predicate, the input instruction is executed on the machine. These embodiments enable players to use a game object as an input device for controlling the machine. The machine may be configured to perform any of a wide variety of different tasks in response to the detected game object, including setting the operational mode of the system and requesting services. In some exemplary embodiments, players can readily and intuitively select a particular style or set of automated enhancements that are provided during a game, request informative services (e.g., a visualization of a suggested shot or a trick shot), and request ancillary services (e.g., place an order for a drink from the bar).

FIG. 1 shows an embodiment of an automated enhancement generation system 10 that includes an imaging system 12, a data processing system 14, a graphical display system 16, and an optional audio production system 17. The data processing system 14 includes a tracking module 18, a graphics generator 20, and an optional user interface component 22. The automated enhancement generation system 10 automatically detects game objects (e.g., billiard balls, cue sticks, a billiard rack, and cue tip chalk) and responds to the detected game objects in one or more ways that enhance a player's experience with the game in its current context. In the illustrated embodiment, the automated enhancement generation system 10 is situated with respect to a billiard table 24 that includes a playing surface 26. In operation, the imaging system 12 captures images 13 that include the playing surface 26 of the billiard table 24. The tracking module 18 tracks the real-time positions of each of one or more billiard game objects in relation to the billiard table 24 based on the captured images. The graphics generator 20 generates display image data 28 that dynamically responds to the tracked real-time positions of the one or more billiard game objects. The graphical display system 16 displays on the billiards table 24 images 30 corresponding to the display image data 28.

In general, the imaging system 12 may include one or more of any type of imaging device, including a computer-controllable digital camera (e.g., a Kodak DCS760 camera), a USB video camera, a Firewire/1394 camera, or a stereo camera. USB video cameras or "webcams," such as the Intel PC Pro, generally capture images at thirty fps (frames per second) at 320×240 resolution, while Firewire cameras (e.g., a Point Grey Research Dragonfly) can capture at higher frame rates and/or resolutions. Stereo cameras (e.g., a Point Grey Research Bumblebee, a Tyzx DeepSea camera, and a 3DVSystems' ZCam) use multiple imagers or light time-of-flight measurement to obtain both appearance and scene distance information at each camera pixel. The imaging system 12 typically remains fixed in place and is oriented toward the billiard table 24. The imaging system 12 typically includes an image sensor (e.g., a charge coupled device (CCD) or a complementary metal-oxide-semiconductor (CMOS) image sensor), a sensor controller, a memory, a frame buffer, a microprocessor, an ASIC (application-specific integrated circuit), a DSP (digital signal processor), and an I/O (input/output) adapter use to transfer image data to a computer. The image data transmitted by the I/O adapter may be processed in real-time by the data processing system 14, or it may be stored on a storage subsystem (e.g., a hard disk drive, a floppy disk drive, a CD-ROM drive, or a non-volatile data storage device) of the data processing system 14 for processing at a later time.

The graphical display system 16 may be implemented by a variety of technologies that display graphical effects on the playing surface 26 of the billiards table 24. The graphical display system 16 typically is a computer-controlled display that allows the displayed graphical effects to be dynamically altered over time using computer software. In the illustrated embodiments, the graphical display system 16 is a light projector mounted above and oriented towards the playing surface 26 of the billiards table 24. The light projector may utilize a wide variety of light sources. Exemplary light sources include strongly colored incandescent light projectors with vertical slit filters, laser beam apparatus with spinning mirrors, LEDs, and computer-controlled light projectors (e.g., LCD-based projectors or DLP-based projectors). In other embodiments, the graphical display system 16 includes one or more flat-panel displays (e.g., based on LCD, plasma, or OLED technology) that are positioned beneath the billiards table playing surface 26. In one such embodiment, a single large LCD panel with a size approximately that of the billiards table playing surface is employed. In these embodiments, the playing surface 26 of the billiards table surface 24 is at least partially transparent so that the flat-panel displays are at least partially visible through the playing surface 26. In one embodiment, the playing surface 26 includes a clear acrylic protective layer that is in contact with the flat-panel displays and is overlaid with a thin, light-colored (e.g., white) felt cloth that allows for a natural feel and ball motion of billiards play.

In some embodiments, the graphical display system 16 and the imaging system 12 both operate in the visible portion of the electromagnetic spectrum. In other embodiments, the graphical display system 16 operates in the visible portion of the electromagnetic spectrum, whereas the imaging system 12 operates in other regions (e.g., infrared or ultraviolet regions; color or strictly grayscale) of the electromagnetic spectrum. In some of these embodiments, the imaging system 12 includes a filter that selectively transmits light in the target electromagnetic spectrum range to the imaging device. In these embodiments, the imaging system 12 also may include one or more light sources that project light in the target electromagnetic spectrum range onto the billiard table 24. In some embodiments, graphical display system 16 may include a filter that selectively blocks transmission of light in the portion of the electromagnetic spectrum that imaging system 12 is designed to sense.

The audio production system 17 may be implemented by a variety of technologies that produce audible sounds in the vicinity of the billiard table 24. In some exemplary embodiments, the audio production system 17 includes an amplifier and one or more speakers.

Embodiments of the data processing system 14 may be implemented by one or more discrete modules (or data processing components) that are not limited to any particular hardware, firmware, or software configuration. In the illustrated embodiments, the modules may be implemented in any computing or data processing environment, including in digital electronic circuitry (e.g., an application-specific integrated circuit, such as a digital signal processor (DSP)) or in computer hardware, firmware, device driver, or software. In some embodiments, the functionalities of the modules are combined into a single data processing component. In some embodiments, the respective functionalities of each of one or more of the modules are performed by a respective set of multiple data processing components.

In some implementations, process instructions (e.g., machine-readable code, such as computer software) for implementing the methods that are executed by the embodiments of the data processing system 14, as well as the data it generates, are stored in one or more machine-readable media. Storage devices suitable for tangibly embodying these instructions and data include all forms of non-volatile computer-readable memory, including, for example, semiconductor memory devices, such as EPROM, EEPROM, and flash memory devices, magnetic disks such as internal hard disks and removable hard disks, magneto-optical disks, DVD-ROM/RAM, and CD-ROM/RAM.

Embodiments of the data processing system 14 typically include a processing unit, a system memory, and a system bus that couples the processing unit to the various components of the computer. The processing unit may include one or more processors, each of which may be in the form of any one of various commercially available processors. Generally, each processor receives instructions and data from a read-only memory and/or a random access memory. The system memory typically includes a read only memory (ROM) that stores a basic input/output system (BIOS) that contains start-up routines for the computer, and a random access memory (RAM). In some embodiments, the data processing system is implemented by a computer that additionally includes a hard drive, a floppy drive, and CD ROM drive that are connected to the system bus by respective interfaces. The hard drive, floppy drive, and CD ROM drive contain respective computer-readable media disks that provide non-volatile or persistent storage for data, data structures and computer-executable instructions. Other computer-readable storage devices (e.g., magnetic tape drives, flash memory devices, and digital video disks) also may be used with the computer. A user may interact (e.g., enter commands or data) with the computer using a keyboard, a pointing device, or other means of input. Information may be displayed to the user on a monitor or with other display technologies. In some embodiments, the computer also may consist of one or more graphics cards, each of which is capable of driving one or more display outputs that are synchronized to an internal or external clock source.

Embodiments of the data processing system 14 may be implemented in any one of a wide variety of electronic devices, including desktop and workstation computers. In some embodiments, the data processing system 14 is implemented as a discrete component that is separate from the graphical display system 16 and the imaging system 12. In other embodiments, the data processing system 14 is incorporated at least in part in one or both of the graphical display system 16 and the imaging system 12.

Some embodiments of the automated enhancement generation system 10 are packaged in manner so that they may easily be substituted for the lighting fixtures typically positioned above billiards tables. In some of these embodiments, the automated enhancement generation system 10 is contained within a compact unit that includes the one or more imaging devices of imaging system 12, one or more projectors forming the graphical display system 16, the data processing system 14, optional audio speakers, and lighting sufficient to illuminate the billiard table playing surface 26 for normal billiards play when automated enhancement generation system 10 is not in operation. This compact unit may be suspended above billiard table 24 using any of the standard methods used to hang lighting or audiovisual fixtures of similar weight and size. In an exemplary embodiment, the compact unit containing the automated enhancement generation system 10 is made to appear like a lamp commonly found suspended above billiards tables. Such lamps often contain the appearance of stained glass panels, or fiberglass panels with advertisements for beer or other products.

III. EXEMPLARY EMBODIMENTS OF AUTOMATED ENHANCEMENTS FOR BILLIARDS AND THE LIKE

A. Overview of System Operation

As explained above: the imaging system 12 captures images 13 that include the playing surface 26 of the billiard table 24; the data processing system 14 tracks the real-time positions of each of one or more billiard balls on the playing surface 26 and generates display image data 28 that dynamically respond to the tracked real-time positions of the one or more billiard game objects; and the graphical display system 16 displays images 30 corresponding to the display image data 28 onto the billiard table 24.

Figure 2:
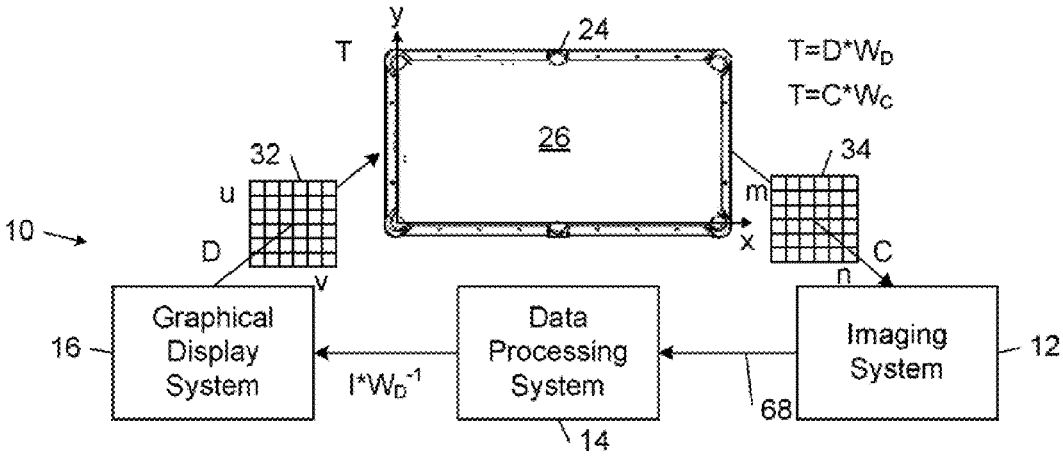
FIG. 2 is a block diagram showing coordinate mappings between the billiard table of FIG. 1 and each of the graphical display system and the imaging system of the automated enhancement generation system of FIG. 1.

FIG. 2 shows coordinate mappings between the billiard table 24 and each of the graphical display system 16 and the imaging system 12 of the automated enhancement generation 10. The graphical display system 16 displays images from a coordinate system with coordinates (u,v) in a display plane 32 (D), and the imaging system 12 captures the images 13 in a coordinate system with coordinates (m,n) in a capture plane 34 (C). In some embodiments, display plane 32 is effectively the 2D graphics frame buffer of the display device used within graphical display system 16, while capture plane 34 is effectively the 2D image constructed by the one or more cameras used within imaging system 12 to observe billiard table playing surface 26. In some embodiments, the data processing system 14 superimposes a rectangular coordinate system with coordinates (x,y) onto the plane (T) of the playing surface 26. As explained in detail below, the data processing system 14 handles coordinate transformations between the playing surface 26 and each of the display plane D and the capture plane (C), and determines the positions of the billiard balls and the images to display in the coordinate system of the playing surface 26.

Figure 3:
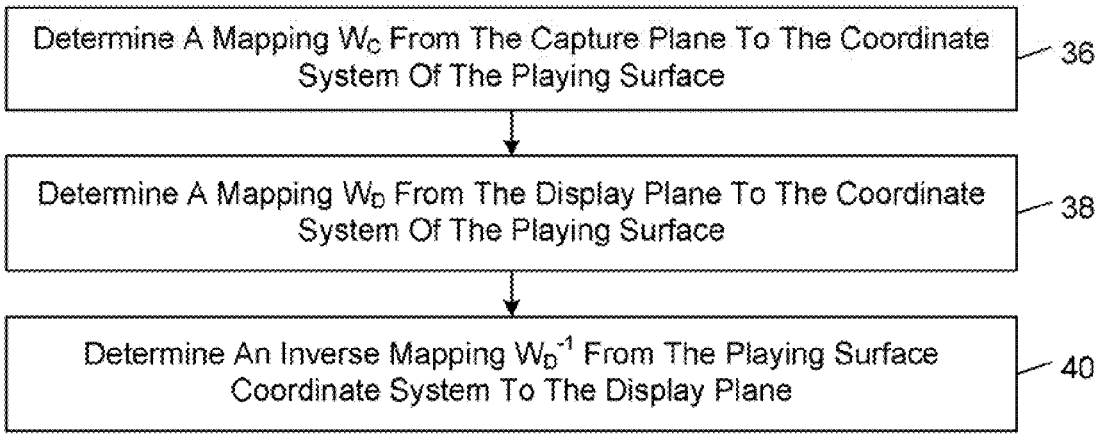
FIG. 3 is a flow diagram of an embodiment of a method of initializing the automated enhancement generation system of FIG. 1.

FIG. 3 shows an embodiment of a method by which the data processing system 14 initializes the automated enhancement generation system 10. In accordance with this method, the data processing system 14 determines a mapping $W_C$ from the capture plane C to the coordinate system of the plane T of playing surface 26, where $C=W_C \cdot T$ (FIG. 3, block 36). The data processing system 14 determines a mapping $W_D$ from the display plane D to the coordinate system of the plane T of playing surface 26, where $D=W_D \cdot T$ (FIG. 3, block 38). The data processing system 14 also determines inverse mappings $W_D^{-1}$ from the playing surface coordinate system to the display plane, where $T=W_D^{-1} \cdot D$ (FIG. 3, block 40), and $W_C^{-1}$ from the playing surface coordinate system to the capture plane, where $T=W_C^{-1} \cdot C$.

The data processing system 14 may determine the mappings $W_C$ and $W_D$ in a wide variety of different ways.

In some embodiments, the data processing system 14 determines the mapping $W_C$ from the capture plane to the coordinate system of the playing surface 26 by locating a set of at least four reference points in images of playing surface 26 captured by imaging system 12 and determining a homography mapping between the reference points and at least four corresponding coordinates representing the physical locations of these reference points within a rectangular, planar coordinate system spanning playing surface 26. In some embodiments, the rectangular, planar coordinate system of playing surface 26 uses coordinates normalized to the coordinate range {(0,0), (1,1)}. The reference points are located automatically in images of playing surface 26 in some embodiments of the invention, while in others they are interactively selected (e.g., via a computer mouse) by a human observing an image of playing surface 26. In some embodiments, the reference points correspond to at least four of the billiard table pocket openings, with their locations being detected either automatically through image processing (e.g., brightness thresholding combined with pattern detection) or human interaction (e.g., with a computer mouse on a display showing a captured image of playing surface 26). Homography mappings may be obtained from at least four point correspondences between planar coordinate systems by well known methods in the art of projective geometry. The resulting homography mapping may be stored in the form of a 3×3 matrix. The data processing system 14 determines the inverse mapping $W_C^{-1}$ from the homography mapping $W_C$ by matrix inversion.

In some embodiments, the data processing system 14 determines the mapping $W_D$ by determining the display plane coordinates of reference points required to illuminate at least four corresponding desired locations on the rectangular, planar coordinate system of playing surface 26. The coordinates of the desired locations on the playing surface 26 represent their physical locations within the plane of the playing surface 26 and may be physically measured by a human operator configuring the system. In some embodiments, the alignment of the reference points with the desired locations is achieved by a human observing playing surface 26 and interactively manipulating via a computer interface the locations of the reference points within a displayed image until they appear at the desired locations on playing surface 26. In other embodiments, light sensors embedded at the desired locations on or near playing surface 26 are used to sense the brightness of imagery displayed by graphical display system 16. In some of these embodiments, graphical display system 16 displays during a calibration phase a series of Gray-coded black-and-white bar patterns, selected via methods well known in the art of computer vision and graphics, such that the time sequence of black and white values displayed by each display plane pixel is unique. Each reading received by the sensors embedded in playing surface 26 is thresholded to classify it as black or white, and the sequence of thresholded readings at each sensor is compared with the sequences produced at each display plane pixel to identify the matching sequence corresponding to the display plane pixel reference coordinate that illuminates the corresponding desired location on playing surface 26. A homography mapping may be obtained using the correspondences between the at least four reference points and the known, desired locations on playing surface 26, using methods well known in the art of projective geometry. The resulting homography mapping may be stored in the form of a 3×3 matrix. The data processing system 14 determines the inverse mapping $W_D^{-1}$ from the homography mapping $W_D$ by matrix inversion.

In some embodiments, the data processing system 14 determines a mapping $F(u,v)=(m,n)$ from the display plane D directly to the capture plane C. The mapping F may be considered a composition of 1) the mapping $W_D$ from the display plane D to the plane T of playing surface 26, and 2) the mapping $W_C^{-1}$ from the playing surface 26 to the capture plane C, so that $F=W_D W_C$. Similarly, the mapping $F^{-1}$ from the capture plane C to the display D may be considered a composition of mappings from capture plane C to playing surface 26 and from playing surface 26 to display plane D, so that $F^{-1}=W_C W_D^{-1}$. Once the mapping F is obtained, it may be used to determine, via matrix multiplication and inversion, the mapping $W_C$ (and its inverse) between the capture plane C and playing surface 26 if given the mapping $W_D$ between the display plane D and playing surface 26. Similarly, once F is obtained, it may be used to determine the mapping $W_D$ (and its inverse) between the display plane D and playing surface 26 if given the mapping $W_C$ between the capture plane C and playing surface 26.

The mapping F may be determined in variety of ways. In some embodiments, the mapping is obtained during a system calibration phase by determining at least four correspondences between reference locations in images displayed by display system 16 and detection locations in images captured by imaging system 12. In some embodiments, the detection locations in the captured images are determined by searching for known patterns displayed at known reference locations one or more display images. In one such embodiment, at least four distinct, localized known patterns (e.g., 2D bar codes) are displayed in a single image by graphical display system 16, and detected by image processing of in a single image captured by imaging system 12. Detection of the capture plane C location (m,n) of each unique pattern displayed at coordinate (u,v) in display plane D provides a correspondence, and a homography between D and C may be computed from four or more such correspondences via methods well-known in the computer vision art. In other such embodiments, exactly one known pattern (e.g., an "X", or a small circle) is present at a known display plane coordinate (u,v) in each image displayed during the calibration phase, and each corresponding captured image is searched via automatic image processing for the corresponding capture plane location (m,n) of the known pattern, thus yielding one correspondence per displayed image. In other approaches, graphical display system displays a series of Gray-coded black-and-white bar patterns on table surface T while imaging system 12 captures an image of each pattern. The patterns are designed such that no graphical display system 16 pixel displays the same sequence of black and white over the course of displaying the pattern set. The data processing system 14 may be used to classify each pixel in the captured images as being "black", white", or neither (i.e. not affected by graphical display system 16) by comparison with an image when graphical display of an all black image is occurring, and the sequence of black and white readings obtained at a given imaging system pixel is used to identify the corresponding unique graphical display system 16 pixel that produced the same sequence. Using at least four such correspondences between pixels in the graphical display system 16 and the imaging system 12, a homography transform may be computed to relate the display plane D and camera plane C.

Figure 4:
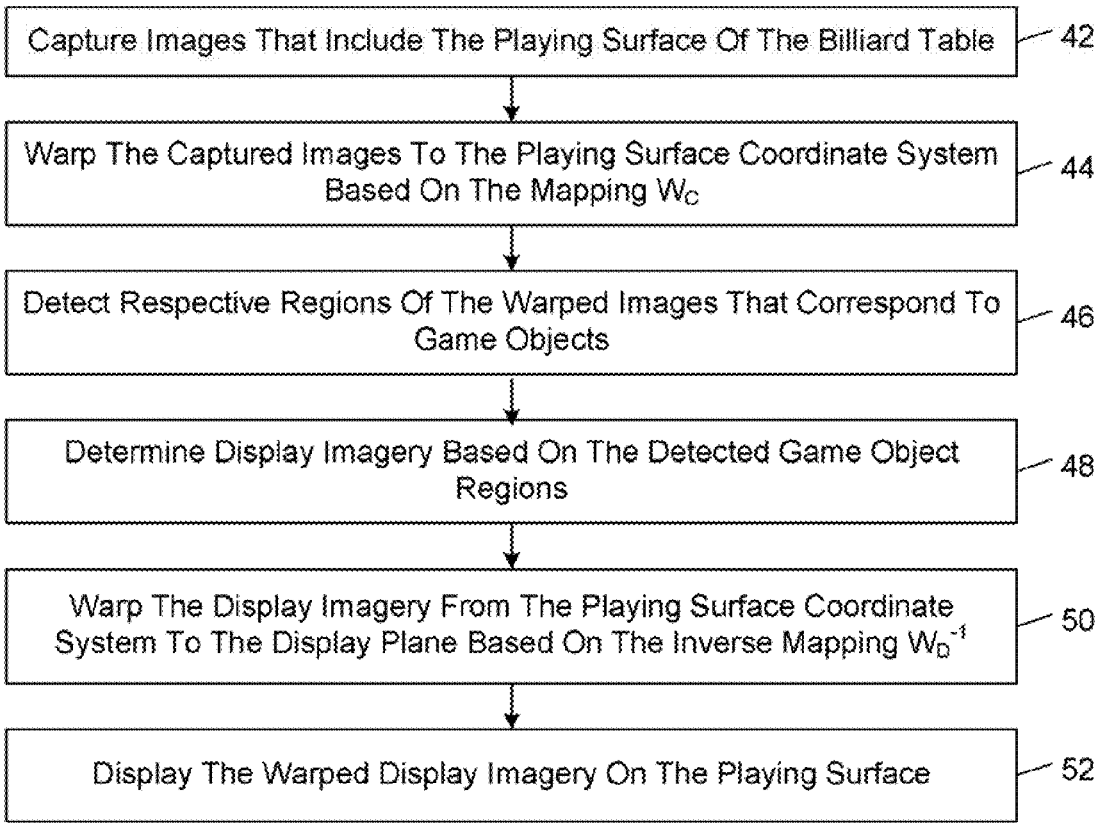
FIG. 4 is a flow diagram of an embodiment of an automated enhancement generation method.

FIG. 4 shows an embodiment of a method by which the automated enhancement generation system 10 automatically enhances a game of billiards being played on the billiard table 24. In accordance with this method, the imaging system 12 captures images that include the playing surface 26 of the billiard table 24 (FIG. 4, block 42). The data processing system 14 warps the captured images 13 to the playing surface coordinate system (x,y) based on the mapping $W_C$ (FIG. 4, block 44). The data processing system 14 detects respective regions of the warped images that correspond to game objects (FIG. 4, block 46). The data processing system 14 determines display imagery in the playing surface coordinate system (x,y) based on the detected game object regions (FIG. 4, block 48). The data processing system 14 warps the display imagery from the playing surface coordinate system (x,y) to the display plane D based on the inverse mapping $W_D^{-1}$ (FIG. 4, block 50). The graphical display system 16 displays the warped display imagery on the playing surface 26 (FIG. 4, block 52). This sequence of steps ensures that the displayed imagery on playing surface 26 is aligned with the detected game object positions and motions on the playing surface.

The elements of the method of FIG. 4 are described in detail below in the following sections.

B. Determine Game Object Parameters

The data processing system 14 detects respective regions of the warped images that correspond to game objects (FIG. 4, block 46) and determines one or more display images based on the detected game object regions (FIG. 4, block 48). In this process, the data processing system 14 determines various game object parameters, including one or more of ball-related parameters (e.g., ball positions, ball velocities, predicted ball trajectories, and ball-related events, such as ball collision events, ball pocketing events, and ball pattern events), cue stick related parameters (e.g., detection, orientation, and cue stick related events, such as ball contact events), rack related parameters (e.g., detection, orientation, and rack related events, such as balls contained within a rack), and cue tip chalk related parameters.

1. Balls a. Ball Positions

In some embodiments, the data processing system 14 detects respective billiard ball regions in the warped images corresponding to respective ones of one or more billiard balls on the playing surface 26.

Figure 5:
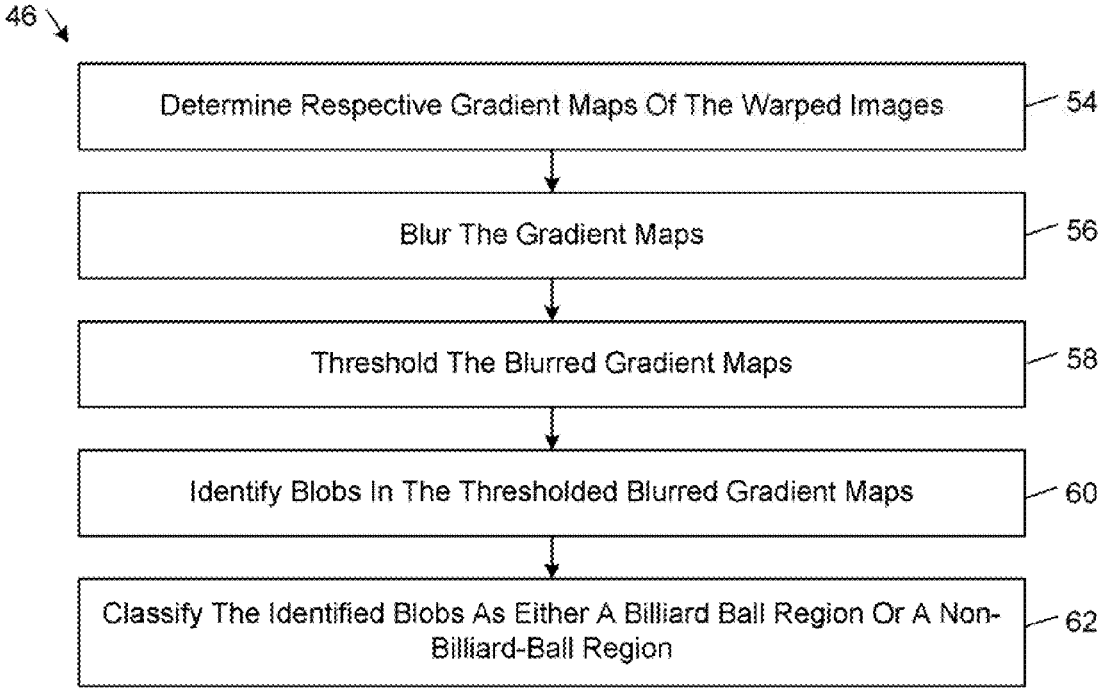
FIG. 5 is a flow diagram of an embodiment of a method of detecting billiard ball regions in images of a playing surface of a billiard table.

FIG. 5 shows an exemplary embodiment of a method by which the data processing system 14 detects billiard ball regions in the captured images.

In accordance with the method of FIG. 5, the data processing system 14 determines respective gradient maps of the warped images (FIG. 5, block 54). In some embodiments, the data processing system 14 uses an edge detector to produce the gradient maps. In general, the data processing system 14 may use any type of edge detection technique to find edges in the warped images. In one exemplary embodiment, the data processing system 14 uses a Sobel edge detector, which performs a two-dimensional gradient measurement on the warped images, to compute edge directions and magnitudes. The Sobel edge detector typically uses a pair of convolution masks, one of which estimates the gradient in the x-direction (columns) and the other of which estimates the gradient in the y-direction (rows).

The data processing system 14 blurs the gradient maps (FIG. 5, block 56). In this process, the data processing system 14 typically applies a blur filter to the gradient maps. In general, the blur filter may be any type of blurring, smoothing, or low-pass filter. In some embodiments, the blur filter processes intensity values derived from the gradient maps in accordance with a set of coefficients that define a spatial filter to produce the blurred gradient maps. The blurred gradient maps are generated by convolving the gradient maps with the filter kernel. In some embodiments, the filter kernel is a K×K rectangle, where K has an odd integer value of 3 or greater and all kernel locations have identical values with the total of all values summing to one. In other embodiments of this type, the blur filter kernel is a K×K kernel of a Gaussian low-pass filter, where K has an odd integer value of 3 or greater. In still other embodiments, the coefficients are recursion coefficients and the blurred gradient maps are generated by multiplying (or weighting) the gradient maps with the recursion coefficients.

The data processing system 14 thresholds the blurred gradient maps (FIG. 5, block 58). In this process, the data processing system 14 applies a threshold (e.g., a global threshold or an adaptive threshold) to the blurred gradient maps to produce respective thresholded blurred gradient maps. The threshold typically is a hard threshold, which produces a binary map that labels edge regions with a "1" value and non-edge (i.e., smooth) regions with a "0" value.

The data processing system 14 identifies blobs in the thresholded blurred gradient maps (FIG. 5, block 60). The data processing system 14 performs a pixel-by-pixel examination of the binary map produced by the thresholding stage in order to identify connected pixel regions (or "blobs", which are regions of adjacent pixels that are as assigned the same label). For each given pixel, the label assigned to the given pixel is compared to the labels assigned to the neighboring pixels. The label assigned to the given pixel is changed or unchanged based on the labels assigned to the neighboring pixels. The number of neighbors examined and the rules for determining whether to keep the originally assigned label or to re-classify the given pixel depends on the measure of connectivity being used (e.g., 4-connectivity or 8-connectivity).

The data processing system 14 classifies the identified blobs as either a billiard ball region or a non-billiard-ball region (FIG. 5, block 62). In this process, the data processing system typically performs shape and size analysis on the blobs. In some embodiments, blobs that meet a circularity predicate and a size predicate are labeled as billiard ball regions and other blobs are labeled as non-billiard-ball regions.

After the billiard ball regions have been detected in the warped images, the data processing determines the centroids of each of the billiard ball regions in the coordinate system (x,y) of the playing surface 26; these positions correspond to the positions of the billiard balls on the playing surface 26. The data processing system 14 typically assigns to each of these ball centroid positions a unique tracking label that is used to track the ball over time. The data processing system 14 stores the centroid positions in a data structure (e.g., a table) that associates these positions with the unique tracking identifiers and a sequence value (e.g., an index number or a time stamp that is associated with the captured image from which the position data was derived).

In some embodiments, the data processing system 14 detects and tracks billiard ball regions directly in the images 13 that are captured by imaging system 12. In these embodiments, the image processing steps of FIG. 5 are applied to the captured images 13 rather than the warped images, for detection and tracking of the billiard balls. The resulting coordinates of the billiard balls are in the (m,n) coordinate system of the capture plane. The coordinate mapping $W_C$ can then be used to map these coordinates to playing surface 26 of the billiard table, so that corresponding display images may be generated by graphics generator 20 to coincide with these playing surface locations. In other embodiments of this type, the coordinate mapping $F^{-1}(m,n)=(u,v)$ is used to transform coordinates of detected billiard balls from the capture plane C directly to the display plane D, and corresponding graphical effects are generated in display images 28 based on these transformed billiard ball locations.

In some embodiments, the data processing system 14 tracks the labeled billiard ball positions across successive frames. The tracking process attempts to match each billiard ball detected through processing of input images captured by imaging system 12 at a given time with tracking labels associated with billiard ball positions that are detected and stored during processing of input images captured at prior times.

Many multi-object tracking methods known in the art are suitable for tracking the multiple billiard balls. Example classes of suitable methods include those based on particle filtering, condensation, joint-probabilistic data-association filters (JPDAF), and Kalman filtering. Tracking algorithms typically include a motion prediction step and an object state (e.g., appearance and location) matching step, such that objects that appear near the predicted location of an object observed at a prior time and have an object state similar to that object are given a high probability of matching. In one embodiment of the invention, billiard balls are predicted to continue to move at their current velocity, where velocity is measured by dividing the difference in ball location between successive captured images by the time between the capturing of the images. If the ball has been seen in only one image, a velocity of zero is used. In this embodiment, object state matching is based solely on object position, so that the billiard ball detected in the current captured imagery nearest the predicted location of a labeled ball from a prior image is assigned the label of that ball. Once a ball label from a prior image is assigned to a ball detected in the current image, it is removed from consideration of matching with other balls detected in the current captured imagery, so that no two labels are assigned to the same ball.

Billiard balls detected in the current captured images that are not within a threshold distance of the predicted position of any ball detected in the previous imagery may be considered newly detected balls, and are given a new label different from that of any ball detected in the previous imagery. Conversely, balls tracked in the previous imagery that are not within a threshold distance of any balls detected in the current imagery may be considered "lost", and are deleted from the stored list of labeled, tracked ball positions. A billiard ball may be "lost" by tracking module 18 when it falls into one of the billiard table pockets. When the last tracked location of a lost ball is within a distance threshold of the entrance of a billiard pocket, tracking module 18 may decide that the ball has been "pocketed" (i.e., has fallen in the pocket).

In other embodiments, the matching step of the tracking process is also based on the grayscale or color appearance of the balls detected in the prior and current images, with more similar appearance causing a higher probability of matching. In still other embodiments, the prediction step also incorporates simulation (based on the laws of physics) of ball collisions with each other and with the boundaries of the table playing surface 26. Embodiments of the invention may also employ tracking methods that, for each known tracked billiard ball in the previous imagery, search within the imagery of the current time for the location whose image data best supports the hypothesis that the ball is present at that location, rather than first detect billiard balls and then attempt to match them with labeled ball positions from previous imagery. This searching may be performed, for example, by identifying the current image location at which image normalized correlation with an appearance model of the ball (e.g., a localized image window around its location in the most recent prior image in which it was tracked) is at a maximum. If the value of the maximum is below a prescribed threshold, then tracking for that ball fails for the current image and it is considered lost.

In some embodiments, the data processing system 14 classifies each of the detected billiard ball regions into a set of ball type classes. For example, in accordance with a first exemplary taxonomy, the data processing system 14 classifies each of the billiard ball regions into one of a "cue ball" class, an "eight-ball" class, and an "other ball" class. In accordance with a second exemplary taxonomy, the data processing system 14 classifies each of the billiard ball regions into one of a "cue ball" class, an "eight-ball" class, a "striped ball", and a "solid ball" class. In accordance with a third exemplary taxonomy, the data processing system 14 classifies each of the billiards ball regions into its own respective class each corresponding to a respective one of the billiard balls.

The data processing system 14 typically classifies the billiard ball regions based on a color analysis of the corresponding regions of the warped images.

For example, in some embodiments, the data processing system 14 classifies a particular billiard ball region into the "cue ball" class in response to a determination that the corresponding region in the warped image is uniformly colored white (as defined by an associated cue ball predicate).

In some embodiments, the data processing system 14 classifies a particular billiard ball region into the "eight-ball" class in response to a determination that the corresponding region in the warped image is substantially colored black (as defined by an associated eight-ball predicate).

With respect to the first taxonomy described above, the data processing system 14 classifies a particular billiard ball region into the "other ball" class in response to a determination that the corresponding region in the warped image satisfies neither the cue ball predicate nor the eight-ball predicate.

With respect to the second taxonomy described above, the data processing system 14 classifies a particular billiard ball region into the "striped ball" class in response to a determination that the corresponding region in the warped image has two uniformly white-colored regions separated by a sufficiently large non-white colored region (as defined by an associated striped ball predicate). The data processing system 14 also classifies a particular billiard ball region into the "solid ball" class in response to a determination that the corresponding region in the warped image is substantially a single non-white and non-black color (as defined by an associated striped ball predicate).

With respect to the third taxonomy described above, the data processing system 14 classifies each of the billiards ball regions into its own respective class using the same classification analysis used with respect to the second taxonomy and further classifies each of the billiard ball regions into the solid ball and striped ball classes based on one or both of the specific colors appearing in the corresponding regions of the warped images and the number labels appearing in the corresponding regions of the warped images.

b. Ball Velocities

In some embodiments, the data processing system 14 determines the velocities of the billiard balls. In this process, the data processing system 14 determines the real-time positions of each of one or more of the billiard balls based on comparisons of the billiard ball regions that are detected in different ones of the captured images and are labeled with the unique label assigned to the billiard ball. In some embodiments, the data processing system assigns to each of the billiard balls a nominal velocity equal to the displacement ($\Delta$) between the position $(x_i,y_i)^b$ of the billiard ball in a current image and the position $(x_{i-1},y_{i-1})^b$ of the identically labeled billiard ball in the preceding image, where i is a temporal indexing value and b is the unique label assigned to the billiard ball.

c. Predicted Ball Trajectories

In some embodiments, the data processing system 14 predicts the trajectories of the billiard balls on the playing surface 26 based on a physical model of ball motion.

In some of these embodiments, the data processing system 14 computes the ball trajectories based on the following motion model:

- N balls are in motion on the playing surface, which is bounded by reflecting bumpers;
- Each ball b has a known current position $(x_i,y_i)^b$, velocity $v(x_i^b),v(y_i^b))$, mass m and radius r (in this model the balls are assumed to have the same mass and radius);
- The balls have elastic collisions with each other and the bumpers, with a small amount of ball momentum being lost in each collision;
- The balls travel in straight lines between collisions;
- A small, constant frictional force between the balls and the table acts to slow ball velocity over time.

At each trajectory prediction time, the data processing system 14 simulates the system of billiard balls to determine their respective trajectories based on the motion model. In some embodiments, the data processing system 14 performs a time-driven simulation in which the position of each ball is updated after each update period and the velocities of the balls are updated after each detected collision. In other embodiments, the data processing system performs an event-driven simulation in which an ordered sequence of predicted ball collisions with each other and the bumpers is simulated.

In other embodiments, the data processing system 14 computes the ball trajectories based on a more sophisticated motion model (see, e.g., Leckie, W. and Greenspan, M. An event-based pool physics simulator. In: Lecture Notes in Computer Science, vol. 4250. Springer-Verlag, pages 247-262 (2006), which describes a motion model that simulates the physics of a billiards game based on a parameterization of ball motion and the predictions of the times of collision events and transitions between motion states).

d. Ball Collisions

In some embodiments, the data processing system 14 detects ball collisions with each other and with the bumpers. In some of these embodiments, the data processing system 14 detects ball collisions with each other whenever two or more ball regions in the warped images are within a prescribed distance of one another. In these embodiments, the data processing system 14 also detects ball collision with the bumpers of the billiard table 24 whenever a ball region in the warped image is within a prescribed distance of a bumper. In other of these embodiments, collisions between two or more ball regions in the warped image are detected when the connected pixel regions, as determined in FIG. 5, step 60, corresponding to the respective ball regions merge to form a single connected pixel region.

e. Ball Pocketing

In some embodiments, the data processing system 14 detects ball pocketing events. In some embodiments, the data processing system 14 detects a pocketing event whenever a ball region is within a prescribed distance of a pocket in one of the warped images and the same ball region cannot be detected in a successive one of the warped images. In other embodiments, each pocket of the billiard table includes a sensor (e.g., an optical sensor or a pressure sensor) that generates an associated signal indicating the presence of a billiard ball in response to a sensed presence of a billiard ball in the pocket. In these embodiments, data processing system 14 determines whether one of the billiard balls has fallen into a pocket of the billiard table based on an analysis of the signal associated with the pocket.

In some of these embodiments, the data processing system 14 detects specific ball pocketing events based on the unique identifier assigned to the ball that has been pocketed. For example, if the data processing system 14 determines that the cue ball has been pocketed, the data processing system 14 sets a flag indicating that a scratch event has occurred. In another example, if the data processing system 14 determines that the eight-ball has been pocketed, the data processing system 14 sets a flag indicating that an eight-ball sinking event has occurred. The flags that are set in response to these detected ball pocketing events may be used by the data processing system to trigger the generation of specific perceptible visual and/or audio effects, as described below.

f. Ball Pattern

In some embodiments, the data processing system 14 is configured to detect specific patterns (or arrangements) of the billiard balls in the warped images of the playing surface 26. In these embodiments, the data processing system 14 typically is configured to detect various close-packed arrangements of the billiard balls.

In one example, the data processing system 14 is configured to detect a close-packed triangular arrangement of fifteen balls and, in response to the detection of such an arrangement, the data processing system 14 sets a flag indicating the start of a billiards game. In some of these embodiments, the data processing system also sets a "game type" flag to one or both of "eight-ball" and "straight pool" in response to the detection of this arrangement of billiard balls on the playing surface 26.

In a second example, the data processing system 14 is configured to detect a close-packed rhomboid arrangement of nine balls and, in response to the detection of such an arrangement, the data processing system 14 sets a start of game flag indicating the start of a billiards game. In some of these embodiments, the data processing system also sets a "game type" flag to "nine-ball" in response to the detection of this arrangement of billiard balls on the playing surface 26.

In a third example, the data processing system 14 is configured to detect a close-packed arrangement of three balls and, in response to the detection of such an arrangement, the data processing system 14 sets a start of game flag indicating the start of a billiards game. In some of these embodiments, the data processing system also sets a "game type" flag to "three-ball" in response to the detection of this arrangement of billiard balls on the playing surface 26.

The flags that are set in response to these detected patterns of billiard balls on the playing surface 26 may be used by the data processing system 14 to trigger the generation of specific perceptible visual and/or audio effects, as described below.

2. Cue Stick

In some embodiments, the data processing system 14 is configured to detect the presence of a cue stick in the vicinity of the billiard table 24.

In some of these embodiments, the data processing system 14 detects a cue based on an analysis of the blobs identified in the thresholded blurred gradient maps in accordance with the process of block 60 of FIG. 5. In these embodiments, the data processing system 14 classifies the identified blobs into one of a "cue stick" class or a "non-cue-stick" class based on shape and size analysis on the blobs. In some of these embodiments, blobs that meet an aspect ratio predicate (e.g., an elongated blob region) and a size predicate (e.g., between a prescribed minimum and maximum size) are labeled as cue stick regions and other blobs are labeled as non-cue-stick regions. In other of these embodiments, the blob shape data, after optional rotation to align with a preferred axis of orientation, is passed though a classifier such as a neural network or support vector machine (SVM) to determine whether the blob corresponds to a cue stick region or not. Color or grayscale appearance data, after optional normalization, may also be supplied to the cue stick classifier in some embodiments. In some embodiments, the data processing system 14 assigns to each of the blobs that is labeled as a cue stick region a unique tracking label that is used to track the cue stick over time. Each of the cue stick regions in a current one of the warped images typically is assigned the same label as the nearest cue stick region that is detected in a preceding one of the warped images.

In addition to detecting the presence of a cue stick, the data processing system 14 also may determine a position and an orientation of the cue stick in the coordinate system (x,y) of the playing surface 26. The orientation of the cue stick is determined as the angle of the principal axis (e.g., as determined through principal components analysis applied to the pixels comprising the cue stick region) of the detected cue stick region with respect to the x-axis of table playing surface 26. Cross sections of the cue stick region in the direction orthogonal to the principal axis may be obtained at various locations along the principal axis, and comparisons of cross section lengths at successive locations may be used to determine the direction along the cue stick principal axis in which the cue stick is becoming narrower. In some of these embodiments, the cue stick tip location is selected as the furthest outlying pixel along the narrowing direction of the cue stick region principal axis. Tracking of the cue stick tip may be achieved in these embodiments by repeated detection of cue stick tips in this manner, followed by application, in the case that multiple cue sticks are present over playing surface 26, of any of the multi-object tracking algorithms described above for billiard balls.

In some embodiments, the data processing system also is configured to detect specific cue stick events based on the tracked position and orientation of the cue stick. For example, if the data processing system 14 determines that the cue stick is positioned over the playing surface, the data processing system 14 sets a "shot starting" flag indicating that a shot is about to be taken. In another example, if the data processing system 14 determines that the cue stick tip has contacted a billiard ball, the data processing system 14 sets a "shot taken" flag indicating that a shot has been taken. Tracking of cue stick tip and billiard ball locations may be accomplished as described above in order to detect the event of taking a shot. In a related example, the data processing system 14 sets a "shot miscue" flag indicating that a miscue has occurred in response to a determination that the billiard ball that was struck by the cue did not travel in the direction of the longitudinal axis of the detected cue stick region.

One or more of the flags that are set in response to these detected cue stick events may be used by the data processing system 14 to trigger the generation of specific perceptible visual and/or audio effects, as described below. In some embodiments, the data processing system 14 generates effects in response to the events that are detected for different types of billiard game objects. For example, in some embodiments, the data processing system 14 triggers the generation of specific perceptible effects related to the start of a billiards game in response to the setting of both the "shot starting" flag and the start of game flag.

3. Chalk

In some embodiments, the data processing system 14 is configured to detect the presence of a cue tip chalk in the vicinity of the billiard table 24.

In some of these embodiments, the data processing system 14 detects a cue tip chalk based on an analysis of the blobs that are identified in the thresholded blurred gradient maps in accordance with the process of block 60 of FIG. 5. In these embodiments, the data processing system 14 classifies the identified blobs into one of a "cue tip chalk" class or a "non-cue-tip-chalk" class based on shape and size analysis on the blobs. In some of these embodiments, blobs that meet an aspect ratio predicate (e.g., a square or cubic region), a size predicate (e.g., between a prescribed minimum and maximum size), and optionally a color analysis predicate, are labeled as cue tip chalk regions and other blobs are labeled as non-cue-tip-chalk regions. In other of these embodiments, the blob shape data is passed though a classifier such as a neural network or support vector machine (SVM) to determine whether the blob corresponds to a cue tip chalk region or not. Color or grayscale appearance data, after optional normalization, may also be supplied to the cue tip chalk classifier in some embodiments.

In some embodiments, the data processing system also is configured to detect cue tip chalk events based on the detection of the cue tip chalk. For example, if the data processing system 14 determines that a cue tip chalk is positioned on a specific part of the billiard table 24 (e.g., on a specific part of one of the rails), the data processing system 14 sets a chalk input flag indicating that a player is providing an input command to the user interface component. The flags that are set in response to these detected cue tip chalk events may be used by the data processing system 14 to trigger the generation of specific perceptible visual and/or audio effects, as described below.

4. Rack

In some embodiments, the data processing system 14 is configured to detect the presence of a rack in the vicinity of the billiard table 24.

In some of these embodiments, the data processing system 14 detects a rack based on an analysis of the blobs identified in the thresholded blurred gradient maps in accordance with the process of block 60 of FIG. 5. In these embodiments, the data processing system 14 classifies the identified blobs into one of a "rack" class or a "non-rack" class based on shape and size analysis on the blobs. In some of these embodiments, blobs that meet a shape predicate (e.g., a triangular region) and a size predicate (e.g., between a prescribed minimum and maximum size) are labeled as rack regions and other blobs are labeled as non-rack regions. In other of these embodiments, the blob shape data is passed though a classifier such as a neural network or support vector machine (SVM) to determine whether the blob corresponds to a rack region or not. Color or grayscale appearance data, after optional normalization, may also be supplied to the rack classifier in some embodiments.

In some embodiments, the data processing system also is configured to detect specific rack events based on the detection of the rack. For example, if the data processing system 14 determines that the rack is positioned on the playing surface 26, the data processing system 14 sets a "racking" flag indicating that the billiard balls are being racked. In another example, if the data processing system 14 determines the rack is positioned on the table and is filled with billiard balls in a pattern or arrangement matching that required to start a known game, such as eight-ball, nine-ball or three-ball, the data processing system sets a "racked" flag indicating the billiard balls are positioned in rack and ready for the start of game play, once the rack is removed. The flags that are set in response to these detected rack events may be used by the data processing system 14 to trigger the generation of specific perceptible visual and/or audio effects, as described below.

5. Rack

In some embodiments, data processing system 14 is configured to detect and track the presence of one or more players in the vicinity of the billiard table 24. In these embodiments, imaging system 12 is used to capture images of playing surface 26 and some of the area around billiards table 24, so that people standing near or leaning over billiards table 24 may be observed. In some of these embodiments, the same camera devices used to detect and track billiard game objects also are used to detect and track players, while in other embodiments, imaging system 12 employs different cameras for these two tasks. Data processing system 14 processes these captured images to determine position and velocity of data of one or more people interacting with billiards table 24. A variety of different methods of detecting and tracking people using video cameras may be used in embodiments of automated enhancement generation system 10. For example, in one such method by M. Harville, "Stereo person tracking with short and long term plan-view appearance models of shape and color," Proceedings of the IEEE International Conference on Advanced Video and Signal based Surveillance, pp. 522-527, Como, Italy, September 2005, a single stereo camera is used to detect and track the floor positions and velocities of multiple people in real time.

C. Inferring the State of a Game

In some embodiments, the automated enhancement generation system 10 infers the state of a game from one or a combination of more than one of the game object parameters described in the preceding section.

In these embodiments, the automated enhancement generation system 10 generates game object data describing a respective current state of each of one or more game objects in relation to a playing surface defining a boundary of a field of play of a game involving use of the one or more game objects in the field of play. The automated enhancement generation system 10 determines a state of the game based on one or more comparisons of the game object data with one or more game state-defining predicates. The automated enhancement generation system 10 identifies one or more perceptible effects that are associated with the determined state of the game, and automatically generates one or more perceptible effects in connection with the billiards game.

1. Inferring a Start of Game Event

In some embodiments, the automated enhancement generation system 10 infers the start of a game from one or a combination of more than one of the game object parameters described above.

In some of these embodiments, the data processing system 14 infers the start of a billiards game based on one or a combination of the following criteria: (i) a detected rack on the playing surface 26, (ii) the detected position of a cue ball on the playing surface 26, (iii) a detected pattern of billiard balls on the playing surface 26, and (iv) the detected position of a cue stick over the playing surface 26.

With respect to the first criterion, if the data processing system 14 determines that a rack is positioned over a specific part of the playing surface 26 (e.g., over the foot spot of the playing surface 26), the data processing system 14 sets a "game starting" flag indicating that a billiards game is starting.

With respect to the second criterion, in response at least in part to the determination that the cue ball position is within a particular area of the playing surface 26 (e.g., the area behind the head string), the data processing system 14 sets the "game starting" flag indicating that a billiards game is starting. In some cases, data processing system 14 also requires that at least one of the third and fourth criteria also is satisfied before it sets the "game starting" flag.

With respect to the third criterion, if the data processing system 14 detects a particular close-packed arrangement of billiard balls (e.g., a triangular fifteen ball arrangement, a rhomboid nine-ball arrangement, or a triangular three-ball arrangement), the data processing system 14 sets the "game starting" flag indicating the start of a billiards game. In some of these embodiments, the data processing system also sets the "game type" flag to a respective value identifying the type of billiards game corresponding to the detected arrangement of billiard balls (e.g., eight-ball, straight pool, nine-ball, and three-ball). In other embodiments, data processing system 14 sets the "game starting" flag if the cue ball position is determined to be between the head string and head end of playing surface 26, and all other balls are in a close-packed arrangement between the foot string and foot end of playing surface 26.

With respect to the fourth criterion, if the data processing system 14 determines that the cue stick is positioned over a particular area of the playing surface 26 (e.g., the area behind the foot string), the data processing system 14 sets the "game starting" flag indicating that a game is about to start. In some cases, if the data processing system 14 determines that the cue stick has contacted a cue ball, the data processing system 14 sets a "game started" flag indicating that a game has started.

The flags that are set in response to these game object events may be used by the data processing system 14 to trigger the generation of specific perceptible visual and/or audio effects, as described below.

2. Inferring a Rule Violation Event

In some embodiments, the automated enhancement generation system 10 infers a violation of a game rule from one or a combination of more than one of the game object parameters described above. In these embodiments, the data processing system 14 determines the current state of the billiard balls on the playing surface 26, and compares the determined current state or the change between the current state and the preceding state of the billiard balls with rule predicates that are derived from a respective set of rules that are associated with the particular type of billiard game being played.

In some exemplary embodiments, the data processing system 14 infers that a rule violation has occurred based on one or more of the following criteria: (i) a detected pocketing of the cue ball; (ii) a detected pocketing of a ball out of sequence, (iii) a detected out-of-order striking of a class of ball by the cue ball or cue stick, and (iv) a detected "table scratch" of the cue ball.

With respect to the first criterion, if the data processing system 14 determines that the cue ball has been pocketed, the data processing system 14 sets a "scratch" rule violation flag indicating that a scratch event has occurred.

With respect to the second criterion, if the data processing system 14 determines that a billiard ball has been pocketed out of order, the data processing system 14 sets an "out-of-order pocketing" rule violation flag indicating that an out-of-order ball pocketing event has occurred. In this process, the data processing system 14 maintains an ordered list of the individual billiard balls or the different classes of billiard that are scheduled to be pocketed in accordance with the type of billiards game being played, and sets the "out-of-order pocketing" rule violation flag whenever a particular ball or class of ball is pocketed out of sequence. An example of out-of-order ball pocketing is pocketing the eight ball in a game of eight-ball before all of the striped or solid balls assigned to a player have been pocketed.

With respect to the third criterion, if the data processing system 14 determines that a billiard ball has been struck out of order by the cue ball or cue stick, the data processing system 14 sets a rule violation flag indicating that an "out-of-order ball striking" rule violation event has occurred. In this process, the data processing system 14 maintains an ordered list of the individual billiard balls or the different classes of billiard that are scheduled to be struck in accordance with the type of billiards game being played, and sets the "out-of-order ball striking" rule violation flag whenever a particular ball or class of ball is struck out of sequence. Out-of-order ball striking may occur in the game of sequence billiards, for example, when the first ball the cue ball strikes on a given shot is not the lowest numbered ball on the table. An out-of-order ball striking may also occur in eight-ball, for example, when a player designated to sink solid-colored balls shoots the cue ball such that it contacts a striped ball before any other. A similar rules violation occurs when a player designated to sink striped balls shoots the cue ball such that it contacts a solid-colored ball before any other. Also, for most billiard games, if data processing system 14 determines that a ball other than the cue ball is struck by the cue stick, data processing system 14 sets a flag indicating an out-of-order ball striking rule violation.

With respect to the fourth criterion, if the data processing system 14 determines that the cue ball satisfies the rules of a "table scratch" for the type of billiard game currently being played, the data processing system 14 sets a rule violation flag indicating that a table scratch event has occurred. The definition of "table scratch" varies across different billiards games or under different house rules, but typically includes one or more of a failure of the cue ball to travel sufficiently far, a failure of the cue ball to strike a bounding bumper of the billiard playing surface, a failure of the cue ball to strike another ball, and a failure of the cue ball to cause another ball to strike a bounding bumper of the billiard playing surface. For example, within some variations of the game of eight-ball, a table scratch may be detected if the tracked cue ball fails both to strike a rail and to cause another ball to strike a rail.

The flags that are set in response to these detected rule violation events may be used by the data processing system 14 to trigger the generation of specific perceptible visual and/or audio effects, as described below.

3. Inferring an End of Game Event

In some embodiments, the automated enhancement generation system 10 infers the end of a game from one or a combination of more than one of the game object parameters described above.

In some of these embodiments, if the data processing system 14 determines that a game-winning billiard ball (e.g., the eight-ball, the money ball, or the last ball of a particular class) has been sunk legally, the data processing system 14 sets an "end of game" flag indicating that a game ending event has occurred. In this process, the data processing system 14 maintains an ordered list of the individual billiard balls or the different classes of billiard that are scheduled to be sunk in accordance with the type of billiards game being played, and sets the "end of game" flag whenever the game-winning billiard ball has been sunk in the proper sequence.

In some of these embodiments, if the data processing system 14 determines that a billiard ball has been sunk legally and that the sinking of that billiard ball gives the player who sunk that ball a score above a prescribed game-winning threshold score, the data processing system 14 sets an "end of game" flag indicating that a game ending event has occurred. In this process, the data processing system 14 maintains a respective score (e.g., a count of the balls sunk) for each of the players of a current billiards game and, after every shot, the data processing system 14 compares the players' scores against the prescribed game-winning threshold score.

D. Automatically Generating Perceptible Effects

1. Generating Perceptible Effects Based on Game Object Parameters

As explained above, some embodiments track real-time positions of each of one or more billiard game objects on a playing surface of a billiard table, and produce perceptible effects that dynamically respond to the tracked real-time positions of the one or more billiard game objects. The perceptible effects can provide a variety of different dynamic and static visual and audio effects that enhance players' experiences with billiards and the like.

a. Billiard Ball Triggered Effects

Embodiments of the automated enhancement generation system 10 generate a variety of different perceptible effects based on the detection of various billiard ball parameters and events.

(i) Billiard Ball In-Motion Effects

Embodiments of the automated enhancement generation system 10 generate perceptible effects that are influenced by the movement of one or more billiard balls over the playing surface 26 of the billiard table 24. Examples of these types of perceptible effects are described in the following sections. In some of these embodiments, the generated perceptible effects may depend in part on the recent history of locations of one or more billiard balls, e.g. their recent movement trails. Also, in some of these embodiments, the automated enhancement generation system 10 determines real-time velocities of each of one or more billiard balls on the playing surface, and produces perceptible effects that depend on the determined real-time velocities of the one or more billiard balls. For example, in some embodiments, the magnitudes of the perceptible effects are a function of the magnitudes of the real-time velocities of the billiard balls.

In some embodiments, the automated enhancement generation system 10 predicts a respective future trajectory of each of one or more billiard balls on the playing surface based on the current respective position and the current respective velocity of the billiard ball, and displays imagery on the playing surface 26 based on the respective future trajectory of each of one or more billiard balls on the playing surface 26 while the one or more billiard balls are still in motion. Examples of displayed imagery based on one or more predicted ball trajectories are provided in the sections below.

Trails and Trajectories

In some embodiments, the automated enhancement generation system 10 displays one or more visible dynamic artifacts trailing at least one of the billiard balls that are moving on the playing surface 26 of the billiard table 24. The artifacts may include simulations of natural phenomena, such as fire, water, smoke, wind, and electrical arcs such as lightning bolts. Embodiments of the automated enhancement generation system 10 may be configured to generate a variety of different artifacts of this type, including realistic fire and smoke imagery constrained to a designated image region (see, e.g., Chiba, et. al., "Two-dimensional visual simulation of flames, smoke and the spread of fire", Journal of Visualization and Computer Animation, Vol. 5, No. 1, pp. 37-53), animations of trails of turbulence in liquid or gaseous fluid flow (see, e.g., Michael E. Goss, "Motion Simulation: A Real Time Particle System for Display of Ship Wakes," IEEE Computer Graphics and Applications, vol. 10, no. 3, pp. 30-35, May/June 1990), and simulation of other natural phenomena of trail generation, such as dragging of an object through sand or dirt, the cutting marks made by an ice skate on ice, the creation of frost as a cold object is dragged across watery ice, or the cutting of cloth or other materials with a sharp edged device such as scissors or a knife, may also be produced by known computer graphics methods. Trailing visible dynamic artifacts may also represent strokes made by an artist on a drawing surface using a drawing tool, such as a paint brush, chalk, pencil, or pen (see, e.g., Aaron Hertzmann, "Painterly Rendering with Curved Brush Strokes of Multiple Sizes", *SIGGRAPH* 98 *Conference Proceedings*, July, 1998, pp. 453-460). The visible trailing artifacts may also include dynamically constructed representations of linear patterns such as roads, ladders, footprints, spider webs, or other patterns that are easily propagated in a linear manner. Other computer graphics methods generating visible trail artifacts may be applied, provided that the necessary calculations may be performed in real-time to follow ball motion.

Figure 6:
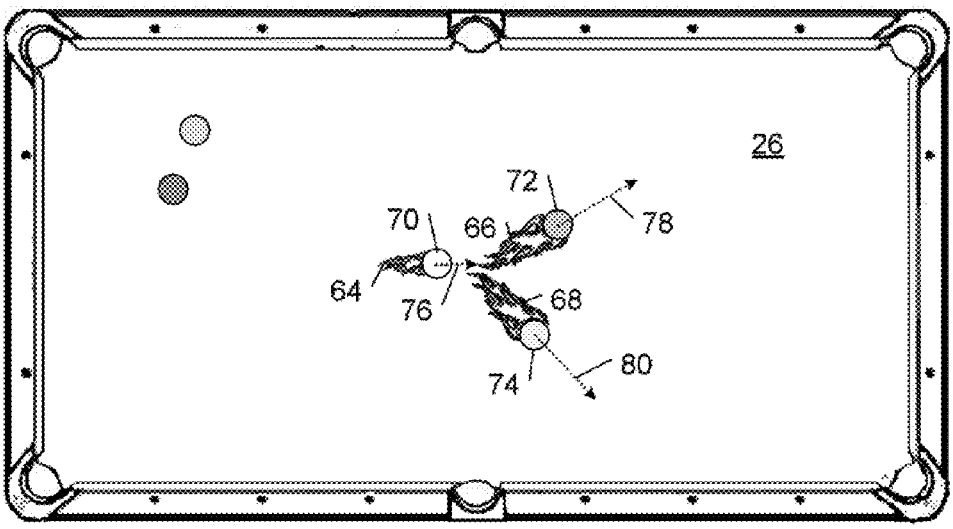
FIG. 6 is a diagrammatic view of embodiments of flame artifacts that are displayed behind moving billiard balls on a playing surface of a billiard table in accordance with an embodiment of the invention.

FIG. 6 shows an exemplary embodiment in which embodiments of flame artifacts 64, 66, 68 are displayed on and behind moving ones 70, 72, 74 of the billiard balls on the playing surface 26. In this embodiment, the magnitudes of the flame artifacts are an increasing function of the magnitudes of the respective velocities 76, 78, 80 of the billiard balls 70-74.

One or more of the types of trailing artifacts discussed above also may be applied in an analogous manner to future trajectories of billiard balls in motion on the playing surface 26. For example, by substituting the beginning of a billiard ball's predicted future trajectory for its recently tracked path, the same algorithms described above may be used to simulate natural phenomena, artistic strokes, repeating patterns, or other visual artifacts along the predicted trajectory.

Reveal

In some embodiments, the automated enhancement generation system 10 displays imagery on the playing surface 26 of the billiard table 24 that shows a scene that is visible only in regions that are revealed near one or more of the billiard balls on the playing surface 26. In general, the revealed regions of the scene imagery may have any of a variety of different shapes. In the illustrated embodiments, the revealed regions are circular regions with a radius that is larger than the radius of the billiard balls. In some embodiments, the automated enhancement generation system 10 displays the imagery on the playing surface 26 such that the visible regions of the scene remain visible after the one or move billiard balls have moved away from the revealed regions. In these embodiments, the revealed regions effectively appear as trails along where the billiard balls have traveled. The revealed regions that are no longer near any of the billiard balls may persist or they may fade gradually over time until these previously revealed regions of the scene are no longer visible. In some embodiments, the revealed regions fade over a period that depends on the length of time that the revealed regions are beyond a threshold distance from the billiard balls. The revealed regions may be implemented through many methods well known in the art of computer graphics and image processing. In one embodiment, a dynamically updated transparency image is applied to the image of the scene to be revealed, and the result is additively composited with a complementary image that is visible where reveal regions are not present. Each pixel in the transparency image stores a value between 0 and 1, inclusive. Mappings are created between the transparency image and the scene and complementary images, respectively, such that each location in the transparency image corresponds to a unique location in each of the scene and complementary images. The transparency, scene, and complementary images are all typically rectangular, with the mappings between them typically being bilinear mappings in the two orthogonal image axes. The transparency map is updated by data processing system 14 based on the motion of the balls, with higher values assigned to regions near where balls are currently positioned or have recently passed, where it is desired to reveal the scene image. Graphics generator 20 generates the current display image to be shown on playing surface 26 by multiplying each pixel in the scene image with the value a from the corresponding location in the transparency image, and adding the multiplication result with the multiplicative product of $(1-\alpha)$ and the corresponding pixel in the complementary image.

Figure 7:
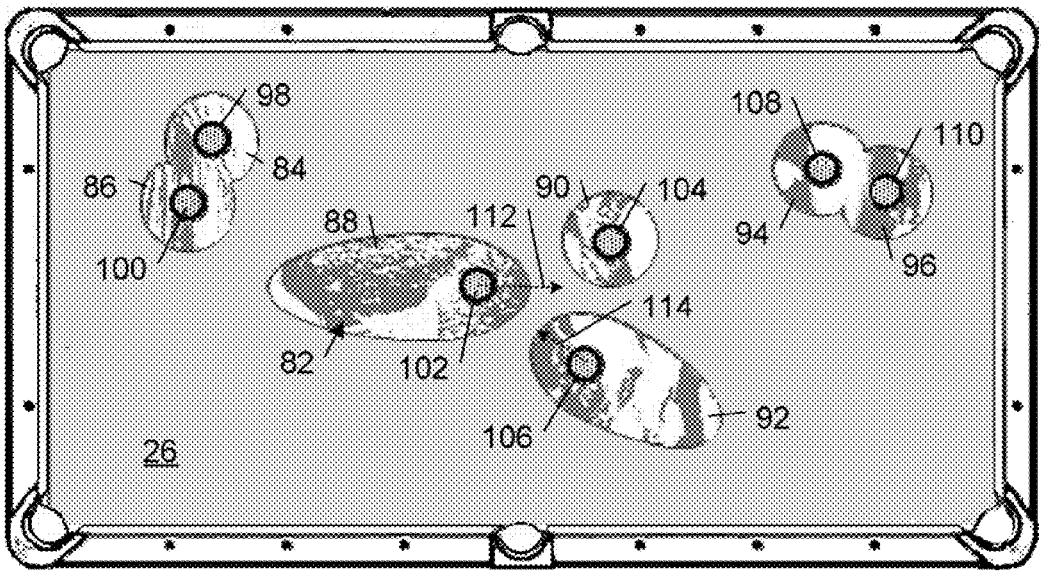
FIG. 7 is a diagrammatic view of a scene that is revealed in circular regions near respective billiard balls on a playing surface of a billiard table in accordance with an embodiment of the invention.

FIG. 7 shows an exemplary embodiment in which a scene 82 is revealed in circular regions 84, 86, 88, 90, 92, 94, 96 near respective ones of the billiard balls 98, 100, 102, 104, 106, 108, 110. The regions 88, 90 that are revealed by the moving billiard balls 102,106 persist for a period that is proportional to the length of time that the revealed regions are beyond a threshold distance (e.g., the difference between the radius of the billiard ball and the radius of the revealed region) from the billiard balls 102, 106. Since the billiard ball 102 is moving faster than the billiard ball 106 (as represented by the velocity arrows 112, 114), the region 88 that is revealed by billiard ball 102 is larger than the region 92 that is revealed by billiard ball 106. In this way, the sizes of the revealed regions are an increasing function of the magnitudes of the billiard ball velocities.

Field Disturbance

In some embodiments, the automated enhancement generation system 10 displays imagery on the playing surface 26 of the billiard table 24 that shows a scene and local disturbances to local regions of the scene near one or more of the billiard balls moving on the playing surface 26. In some of these embodiments, the local disturbances are produced by simulation of natural phenomena such as fluid dynamics of liquids (e.g., water) or gas (e.g., smoke), or changes in electromagnetic fields in response to moving charges or magnets. For real-time generation of fluid dynamics imagery, any of the methods known in the art of computer graphics for real-time generation of imagery of fluid dynamical simulation may be used (see, e.g., Kass and Miller, "Rapid, stable fluid dynamics for computer graphics", in ACM SIGGRAPH Computer Graphics Volume 24, No. 4, August 1990). Visualization of changing electromagnetic fields may be implemented by any real-time methods known in the art of computer vision (see, e.g., Andreas Sundquist, "Dynamic line integral convolution for visualizing streamline evolution", IEEE Transactions on Visualization and Computer Graphics, Vol. 9, No. 3, July/September 2003). Other means of simulating disturbances of fields of particles or fluids in response to moving forces, according to any set of defined rules either natural or non-natural, may also be employed by graphics generator 20 to create display imagery for display on playing surface 26.

Figure 8:
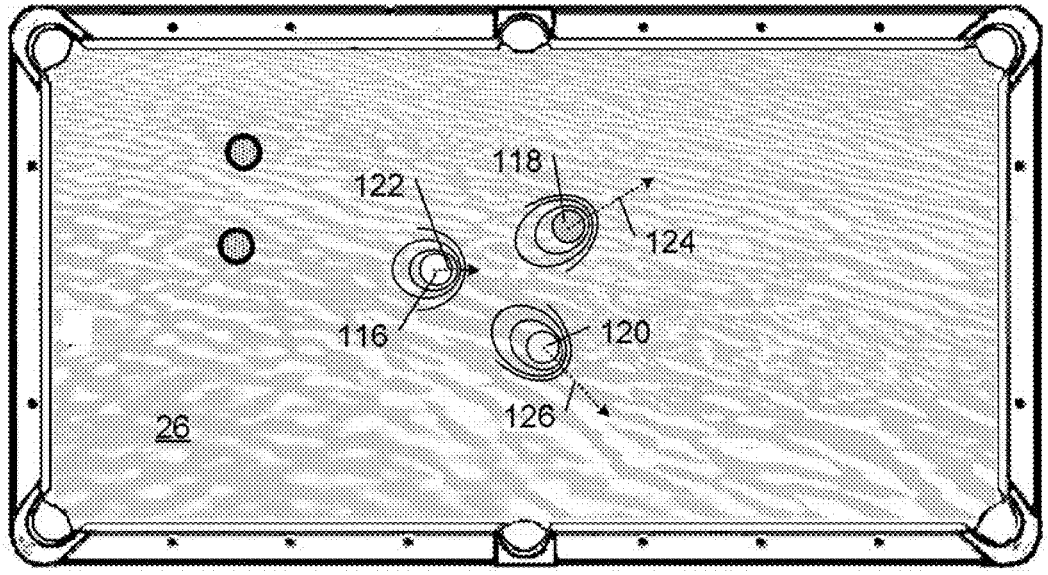
FIG. 8 is a diagrammatic view of a scene that is displayed on a playing surface of a billiard table along with local disturbances to local regions of the scene that are displayed near the billiard balls that are moving on the playing surface in accordance with an embodiment of the invention.

FIG. 8 shows an exemplary embodiment in which a scene is displayed on the playing surface 26 of the billiard table 24 and local disturbances to local regions of the scene are shown near the billiard balls 116, 118, 120 that are moving on the playing surface 26. In this embodiment, the local disturbances are ripples or wave fronts that emanate from the moving billiard balls 116-120. The magnitudes of the ripples are an increasing function of the magnitudes of the respective velocities 122, 124, 126 of the billiard balls 116-120.

Connectivity Effects

In some embodiments, the automated enhancement generation system 10 displays one or more visible artifacts connecting respective pairs of the billiard balls. Example connecting artifacts include representations of rigid lines, elastic springs, strings in fluid, or transmitted electromagnetic waves, and physics simulations may be employed to update the appearance of these connectors as ball positions change, so that the imagery of the connectors behave realistically in accordance with the physical connectors they represent. For example, the appearance of a string could be modified to appear more stretched as the distance between connected balls changes, using Hooke's Law to estimate the force that is stretching the spring. A variety of different rules may be used to determine which pairs of the billiard balls are connected by respective connecting artifacts. For example, each ball may be connected with its nearest neighbors such that no connectors cross each other. This connectivity pattern may be achieved by first connecting each ball with its closest neighbor, and then connecting each ball with its second nearest neighbor if that connection would not cross a previously created connection, followed by connecting each ball with its third nearest neighbor if that connection would not cross a previously created one, and so on.

Figure 9:
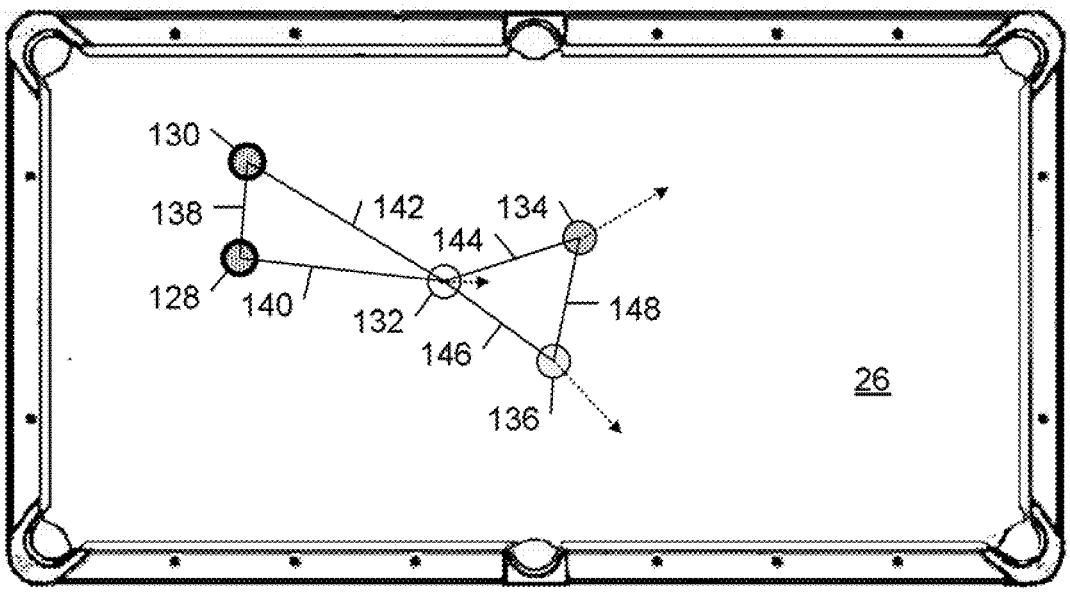
FIG. 9 is a diagrammatic view of pairs of billiard balls that are interconnected by respective visible lines of a light graph that is displayed on a playing surface of a billiard table in accordance with an embodiment of the invention.

FIG. 9 shows an exemplary embodiment in which pairs of the billiard balls 128, 130, 132, 134, and 136 are interconnected by respective visible lines 138, 140, 142, 144, 146, 148 that are displayed on the playing surface 26 of the billiard table 24. In this example, the light graph that is formed by the displayed lines that interconnect the billiard balls change in response to the movement of the moving billiard balls 132, 134, 136.

Region-Based Effects

In some embodiments, the automated enhancement generation system 10 displays on the playing surface 26 visible artifacts that divide the surface into regions based on the positions or motions of at least one billiard ball. In some embodiments, one or more balls define a region that includes the respective ball position, moves with the respective ball, and has any shape or coloring. In some of these embodiments, only selected classes of balls (e.g., the solids or stripes in a game of eight-ball) have region artifacts created around them.

In some embodiments, the automated enhancement generation system 10 illuminates each of the one or more billiard balls on the playing surface 26 with a narrow beam of light that highlights the illuminated balls to make them more easily visible to the players. Embodiments of the automated enhancement generation system 10 illuminate one or more of the billiard balls during detected periods between shots, while the balls are in motion, or in both types of situations. In some of these embodiments, automated enhancement generation system 10 generates additional visible effects such as those described in the sections above (e.g., field disturbances), while also illuminating the balls with a narrow beams of light. This helps the players see the balls more easily despite potentially distracting visual effects.

In other embodiments, one or more balls define regions representing the physical space on the playing surface nearer to the respective ball than to any other ball. In some of these embodiments, a Voronoi diagram is defined with respect to the determined real-time positions of the billiard balls on the playing surface 26. In general, the automated enhancement generation system 10 may generate the Voronoi diagram in a variety of different ways using the current positions of the billiard balls as the Voronoi sites.

Figure 10:
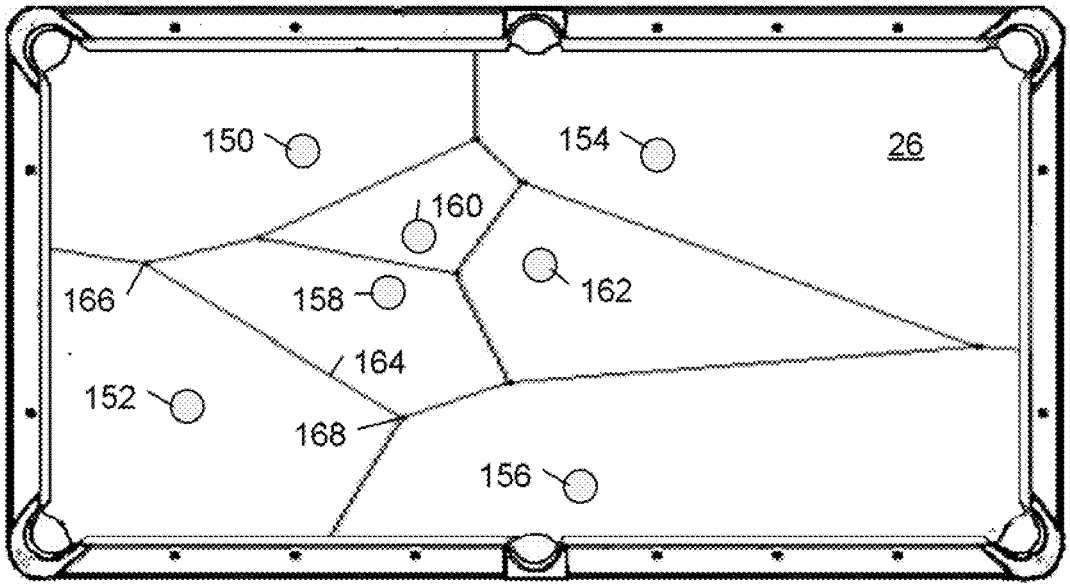
FIG. 10 is a diagrammatic view of an embodiment of a Voronoi diagram that is displayed on a billiard table, where the current positions of billiard balls on a playing surface of the billiard table are the Voronoi sites of the Voronoi diagram in accordance with an embodiment of the invention.

FIG. 10 shows an exemplary embodiment in which the current positions ($p_i=(x_i,y_i)$) of the billiard balls 150, 152, 154, 156, 158, 160, 162 are the Voronoi sites. Each of the current positions $p_i$ has a respective Voronoi cell $V(p_i)$ that consists of all points closer to $p_i$ than to any other position $p_j$. The segments (e.g., segment 164) of the Voronoi diagram are all the points in the plane that are equidistant to two of the current positions of the billiard balls. The Voronoi nodes (e.g., nodes 166, 168) are the points equidistant to three (or more) of the current positions of the billiard balls. One or more of the Voronoi cells may be displayed with different colors.

Video Replay

In some embodiments, the automated enhancement generation system 10 displays on the playing surface 26 a replay of the previous shot. In some of these embodiments, video captured by imaging system 12 is displayed on a portion of playing surface 26, optionally after geometric transformation, cropping, color adjustment, or other image processing to enhance its appearance. In some exemplary such embodiments, video captured by imaging system 12 is warped to the coordinate system of graphical display system 16 via mapping $F^{-1}=W_C W_D^{-1}$, so that the displayed video is aligned with playing surface 26. In some of these exemplary embodiments, initiation of the playback of the previous shot may begin at any time after the balls have ceased their motion that resulted from the shot. In other of these exemplary embodiments, the video playback of a shot begins while the balls are still in motion during that shot, so that copies of the balls appear to be following themselves. In these embodiments, multiple instances of video playback starting at different times may be displayed simultaneously, so that multiple copies of each respective billiard ball appear to be following each corresponding actual ball on playing surface 26.

(ii) Dynamic Billiard Ball Event Effects

In some embodiments, the automated enhancement generation system 10 produces one or more dynamic effects that are associated with respective billiard ball events.

Effects Triggered by Billiard Ball Collision Events

In some embodiments, the automated enhancement generation system 10 detects a collision between two or more billiard balls based on the position data. In response to detection of a collision, the automated enhancement generation system 10 produces a perceptible effect (e.g., an audible sound, or a visible effect on or near the location of the collision). In some of these embodiments, the automated enhancement generation system 10 detects a specific billiard ball collision event (e.g., a break event at the beginning of a billiards game), and in response produces a perceptible effect that is associated with that specific event.

In some embodiments, the automated enhancement generation system 10 determines when a billiard ball contacts a bumper of the billiard table. In response to detection of the bumper collision, the automated enhancement generation system 10 produces a perceptible effect (e.g., an audible sound, or a visible effect on or near the location of the collision). In some of these embodiments, the automated enhancement generation system 10 displays a visible special effect (e.g., a flash of light) on the bumper involved in the collision in response to a determination that a billiard ball has contacted the bumper. In some of these embodiments, the automated enhancement generation system 10 plays an audible special effect (e.g., the "ding" of a bell) in response to a determination that a billiard ball has contacted a bumper. An example embodiment of the invention generates both a visible flash on the contacted bumper and an audible bell ring, in a manner mimicking that which happens in typical arcade pinball machines when the pinball bounces off a pinball game bumper outfitted with a sensor and solenoid.

Effects Triggered by Billiard Ball Pocketing Events

In some embodiments, the automated enhancement generation system 10 detects a billiard ball pocketing event based on the position data. In response to detection of the billiard ball pocketing event, the automated enhancement generation system 10 produces a perceptible effect (e.g., an audible sound, or a visible effect on or near the location of the pocketing event) that highlights or emphasizes the experience associated with the pocketing of the billiard ball. In some of these embodiments, a visible effect includes highlighting or flashing light on the pocket in which the billiard ball sank. Some embodiments play an audible effect (e.g., an explosion, a bell ringing, or applause) when the ball is pocketed, and this effect may continue for a short period of time after the pocketing event occurs. An example embodiment of the invention both visibly highlights the pocket and plays an audible enhancing sound when pocketing of a billiard ball is detected. In some embodiments, the visible and audible effects associated with a pocketing event are selected based on the class of ball pocketed. For example, when the cue ball is pocketed, a distressing sound (e.g., a buzzer or voices "booing") may be played.

(iii) Static Billiard Ball Effects

In some embodiments, the automated enhancement generation system 10 detects certain static billiard ball situations based on the position data and, in response, the automated enhancement generation system 10 produces perceptible effects (e.g., an audible sound, or a visible effect) that are associated with those static billiard ball situations. Examples of these types of effects are described in the following subsections.

Suggest Shot Based on Current Ball Configuration

In some embodiments, the automated enhancement generation system 10 displays on the playing surface 26 a visualization of a virtual billiards shot from a current state of a billiards game being played on the billiard table. In some embodiments, the automated enhancement generation system 10 determines a candidate shot (e.g., a shot that involves sinking a respective one of the balls assigned to the player who currently is up to take a shot). In some of these embodiments, the automated enhancement generation system 10 highlights (e.g., with a narrow beam of light) the ball that the system determines should be hit next. In other ones of these embodiments, the automated enhancement generation system 10 displays a graphical representation of the suggested shot from the cue ball to the ball that should be pocketed. Some of these embodiments also show the paths that one or more non-cue balls will travel if the cue ball is struck as suggested. The suggested shot may be a standard (e.g., conservative) shot or it may be a trick shot depending on the system settings, which may be configured by the players (e.g., using an embodiment of the user interface described below). In some embodiments, the shot suggestion may also include a suggestion for cue stick angle and style of cue stick movement, for example to produce the proper "English" or spin on the cue ball after it is struck by the cue stick.

b. Cue Stick Triggered Effects

In some embodiments, the automated enhancement generation system 10 detects a cue stick and displays imagery on the detected cue stick. For example, in some of these embodiments, the automated enhancement generation system 10 displays an elongated beam of light along the longitudinal axis of the cue stick while a player is aiming the cue stick. In other embodiments, the automated enhancement generation system 10 displays imagery on or near the cue stick in response to certain cue stick related events. For example, in some of these embodiments, the automated enhancement generation system 10 may display an emphasis effect (e.g., a ribbon of flame) on the cue stick in response to a determination that the cue stick was involved in a successful shot or break event (as defined, e.g., by a cue stick emphasis predicate). In another example, the automated enhancement generation system 10 may display an emphasis effect (e.g., an explosion, lightning, a gunshot sound, or a water splash) in response to a determination that the cue stick has contacted the cue ball during a shot. The emphasis effect may combine both visible and audible components, with the visible components located near the point of contact between the cue stick and the cue ball.

In some embodiments, the automated enhancement generation system 10 changes one or more parameters that influence the visual appearance of the imagery displayed on the playing surface 26 in response to the detection of the cue stick over the playing surface. For example, in some of these embodiments, the automated enhancement generation system 10 dims or otherwise reduces the intensity of any imagery that currently is being displayed on the playing surface 26 in response to a determination that a player is about to take a shot. In another example, the automated enhancement generation system 10 creates new field disturbance or trailing effects, according but not limited to the example methods described for billiard ball motion in sections above, as if the tip of the cue stick were the position of a moving ball, thereby allowing the players to interactively affect the automated enhancement generation without having to strike a ball. In these embodiments, data processing system 14 contains a cue stick tip tracking component, capable of detecting and tracking one or more cue stick tips, with the cue stick tip tracker employing tracking methods similar to those used by the billiard ball tracking component.

In some embodiments, the automated enhancement generation system 10 predicts the trajectories of billiard balls on the playing surface 26 from their current configuration on the playing surface 26 and the current orientation of the cue stick in relation to the playing surface 26. In these embodiments, the automated enhancement generation system 10 displays the predicted ball trajectories on the playing surface in real time as the orientation of the cue stick in relation to the playing surface 26 is changed by a player.

2. Effects Generated Based on Inferred State of Game

Some embodiments of the automated enhancement generation system 10 are capable of automatically inferring a state of a billiards game that is being played based on position data describing a respective current position of each of one or more billiard game objects in relation to the billiard table 24. These embodiments are able to select one or more perceptible effects that are associated with the determined state of the billiard game, and produce the one or more perceptible effects in connection with the billiards game. In some embodiments, automated enhancement generation system 10 stores game play rules associated with one or more types of billiard games (e.g., eight-ball, nine-ball, or sequence). These rules are used to construct predicates that trigger one or more perceptible effects in response to billiard game events that depend on the type of billiard game being played.

a. Start-of-Game Effects

As explained above, embodiments of the automated enhancement generation system 10 are capable of detecting the occurrence of an event relating to a start of a billiards game and, in response, producing in the vicinity of the billiard table 24 a perceptible effect (e.g., imagery or an audible sound) that is associated with a start of a billiards game. The start of the billiards game may be ascertained based on the detection of a particular static arrangement of billiard balls on the playing surface 26, the detection of a billiard ball rack on the playing surface and a count of billiard balls in the rack, and the identification of each of one or more of the billiard balls on the playing surface. In general, the automated enhancement generation system 10 may generate a wide variety of different visual and audio effects in response to the detection of a start-of-game event. In some embodiments, a musical clip is played to indicate that a game is starting. In some of these embodiments, the music is chosen to provide a mood of anticipation, and may include a "drum roll", trumpet fanfare, or fast-paced rock music. In other embodiments, an audible sound effect is played, such as a race car engine being accelerated to high idle speed. Visual effects displayed in response to a detected start of game may include, but are not limited to, repeated flashing of all or part of playing surface 26 for some period of time, fiery explosions appearing at random locations across all of the playing surface 26, and simulation of a pulsating glow around the cue ball and racked balls. Embodiments of the invention may combine audible and visual effects in response to the detection of a start-of-game event, and may produce multiple different effects in sequence.

b. In-Game Effects

The automated enhancement generation system 10 may generate a wide variety of different effects in response to the detection of certain events during a game.

For example, some embodiments of the automated enhancement generation system 10 determine whether one of the billiard balls has fallen into a pocket of the billiard table and, in response to a determination that the billiard ball has fallen in the pocket, the automated enhancement generation system 10 selects event-specific imagery associated with an event of a billiard ball falling in a pocket and displays the selected event-specific imagery on the billiard table. In some embodiments, the automated enhancement generation system 10 produces an audible sound in response to a determination that a billiard ball has fallen in a pocket of the billiard table 24.

Some embodiments of the automated enhancement generation system 10 determines whether a cue ball has fallen into a pocket of the billiard table and, in response, the automated enhancement generation system 10 displays event-specific imagery associated with a scratch event on the billiard table. For example, in response to a determination that the cue ball has fallen into the pocket, some embodiments of the automated enhancement generation system 10 displays event-specific imagery prompting removal of the cue ball from the pocket on the billiard table 24. The automated enhancement generation system 10 also may display on the billiard table event-specific imagery (e.g., a line or other boundary) that demarcates a region where the cue ball should be placed on the playing surface 26, by the player whose turn is next, in response to a determination that the cue ball has fallen into the pocket as a result of the previous player's shot.

Some embodiments of the automated enhancement generation system 10 are capable of tracking the status of a billiards game in progress and displaying on the billiard table one or more game status indicators that indicate the current status of the billiards game. In some of these embodiments, the automated enhancement generation system 10 captures images of the playing surface, tracks a score of a billiards game being played based on an analysis of the captured images, and produces an event-specific perceptible effect that is associated with a score of a billiards game. For example, in some embodiments, the automated enhancement generation system 10 displays the tracked score of the billiards game on the billiard table 24. In some of these embodiments, the automated enhancement generation system 10 establishes a respective identity of each of one or more of the billiard balls on the playing surface 26, detects the scoring event based on the established identities of the one or more billiard balls, and in response to the detection of an event involving the one or more of the billiard balls whose identities have been established, the automated enhancement generation system 10 produces near the billiard table a perceptible effect that depends on the established identity of each of the one or more billiard balls involved in the event. For example, in some cases the automated enhancement generation system 10 determines the score based on the identity of a ball that was pocketed and, in response to a detection of the scoring event, the automated enhancement generation system 10 produces an event-specific perceptible effect associated with the determined score of the billiards game. The event specific perceptible effect associated with the determined score may include a wide variety of visible and audible effects, including but not limited to ringing of a bell, verbal announcement of the new score, applause, display of the new score on or near the table playing surface 26, display of an animation on playing surface 26, and any combination thereof.

In some embodiments, the automated enhancement generation system 10 ascertains periods between billiards shots, and displays imagery on the billiard table 24 during the ascertained periods. In this process, the automated enhancement generation system 10 detects an end-of-shot event that is associated with a completion of a billiards shot during a game being played on the billiard table, and displays the imagery in response to a detection of the end-of-shot event. The end-of-shot event may be detected, for example, by data processing system 14 as the time at which all tracked billiard ball locations cease to change after a "shot taken" event has been detected. In some of these embodiments, the imagery that is displayed on the billiard table during the ascertained periods includes at least one advertisement. Each advertisement may include static images, video imagery, displayed text, or any combination thereof, and may be accompanied by playing of associated audio.

Some embodiments of the automated enhancement generation system 10 detect the occurrence of an event relating to the ascertained type of billiards game (e.g. eight-ball, sequence, or three-ball) based on an analysis of one or more of the images captured by the imaging system 12. The automated enhancement generation system 10 selects event-specific imagery associated with the detected event, and displays the selected event-specific imagery on the billiard table 24 in response to the detection of the event.

In some of these embodiments, the automated enhancement generation system 10 detects a billiard game rules violation event corresponding to a failure of comply with a rule of the ascertained type of billiards game based on the tracked position data. In some of these embodiments, the automated enhancement generation system 10 establishes a respective identity of each of one or more of the billiard balls, and detects the game rules violation event based on the established identities of the one or more billiard balls. In response to a detection of the rules violation event, the automated enhancement generation system 10 produces an event-specific perceptible effect associated with a billiards game rules violation. Among the exemplary types of rules violation events that are detectable are hitting the incorrect ball out-of-sequence in a game of sequence billiards, hitting the incorrect class (e.g., solid or striped) of ball first in a game of eight-ball, cue ball scratches, and table scratch events defined according to the rules of the type of game being played.

c. End-of-Game Effects

Embodiments of the automated enhancement generation system 10 detect an end-of-game event that is associated with a completion of the billiard game being played on the billiard table 24 based on the tracked position data. In response to a detection of the end-of-game event, the automated enhancement generation system 10 produces an event-specific perceptible effect associated with an end of a billiards game. Exemplary types of visible effects that may be generated in response to the detection of an end-of-game event include, but are not limited to, repeated flashing of the table, playing of an animation (e.g., fireworks) associated with completing a game winning shot, and replaying video of the game winning shot, or any combination thereof. Exemplary types of audible effects that may be generated in response to the detection of an end-of-game event include, but are not limited to, triumphant music, cheering, and sounds of fireworks, or any combination thereof. In some embodiments, advertisements are displayed on the billiard table in response to the detection of the end-of-game event and between billiard games. The advertisements may include static images, video imagery, displayed text, audio clips, or any combination thereof.

In some of these embodiments, the automated enhancement generation system 10 establishes a respective identity of each of one or more of the billiard balls, and detects the end-of-game event based on the established identities of the one or more billiard balls. In some embodiments, the automated enhancement generation system 10 ascertains a type of a billiards game being played on the billiard table based on an evaluation of one or more of the captured images, and determines the state of the billiards game based on the ascertained type of billiards game being played. In some embodiments, the automated enhancement generation system 10 determines the state of the billiards game based on the respective identities of the billiard balls and the ascertained type of billiard game being played. For example, in some embodiments, the automated enhancement generation system 10 detects an end-of-game event when the eight ball is pocketed legally (i.e., the player has pocketed all of his designated balls prior to pocketing the eight ball, hits the eight ball first with the cue ball, and does not sink the cue ball on the shot that pockets the eight ball) in an eight-ball billiards game.

In some embodiments, the automated enhancement generation system 10 displays imagery that is associated with the determined state of the game on the billiard table 24. In some embodiments, in response to the detection of an end-of-game event, the automated enhancement generation system 10 produces near the billiard table 24 a perceptible effect that depends on the established identity of each of the one or more billiard balls involved in the event. For example, when a game of eight-ball ends, the balls belonging to the losing player that still remain on playing surface 26 may be highlighted in sequence to indicate a score to be counted against that player.

In some embodiments, after detection of an end-of-game event, the automated enhancement generation system 10 displays video replays on billiard table playing surface 26 of previous shots taken in a billiards game. In some of these embodiments, the entire sequence of shots taken during the most recently completed billiards game is replayed. Knowledge of end-of-shot events can be used to optionally remove ascertained time periods between shots from the replayed shot sequence, and video processing (e.g., video frame insertion or deletion) can be used to speed up or slow down the replay of the shots to be faster or slower than real time, respectively. In other of these embodiments, a user interface is displayed on playing surface 26 to allow human users to select which shots of previously completed billiard games to display as a video replay on playing surface 26. Imaging system 12 is used to sense how users are interacting with the displayed interface. Some embodiments of the user interface require the users to select actions by positioning billiard game objects in appropriate zones on the table.

E. User Interface

Some embodiments of the automated enhancement generation system 10 interface players with a machine (typically the data processing system 14). In these embodiments, position data is generated (for example, using imaging system 12 and detection and tracking methods described above, or based on other types of sensing devices associated with the playing surface). The position data describes a respective current position of each of one or more game objects in relation to the playing surface. A determination is made whether the position data satisfies an input instruction predicate. In response to a determination that the position data satisfies the input instruction predicate, the input instruction is executed on the machine. These embodiments enable players to use a game object as an input device for controlling the machine. The machine may be configured to perform any of a wide variety of different tasks in response to the detected game object, including setting the operational mode of the system and requesting services. In some exemplary embodiments, players can readily and intuitively select a particular style or set of automated enhancements that are provided during a game, request informative services (e.g., a visualization of a suggested shot or a trick shot), and request ancillary services (e.g., place an order for a drink from the bar).

In some embodiments, the automated enhancement generation system 10 displays graphical interface imagery on the billiard table 24. The automated enhancement generation system 10 determines whether the position data in relation to the displayed graphical interface imagery satisfies an input instruction predicate. In response to a determination that the position data satisfies the input instruction predicate, the automated enhancement generation system 10 executes the input instruction on the machine.

In some of these embodiments, the graphical interface imagery demarcates a visible interface zone on the playing surface, and the automated enhancement generation system 10 determines whether at least one of the game objects is present in the interface zone. In this process, the automated enhancement generation system 10 typically determines whether the at least one game object is in the interface zone for at least a prescribed period of time.

In some embodiments, in response to a determination that the presence of the at least one game object in the interface zone satisfies the input instruction predicate, the automated enhancement generation system 10 selects an operational mode of the machine from a set of different operational modes. Each of the operational modes in the set typically is associated with a different respective process of generating perceptible effects during the game.

In some embodiments, the automated enhancement generation system 10 detects a configuration of the one or more of the game objects on the playing surface, and executes the input instruction in response to a determination that the detected configuration satisfies the input instruction predicate. In some of these embodiments, the automated enhancement generation system 10 determines whether an arrangement of multiple ones of the game objects matches a prescribed pattern, and executes the input instruction in response to a determination that the arrangement of the game objects matches the prescribed pattern (e.g., a pattern of billiard balls that corresponds to a target racked ball pattern). In response to a determination that the arrangement of the game objects matches the prescribed pattern, the automated enhancement generation system 10 may, for example, select an operational mode of the machine from a set of different operational modes corresponding to different types of game being played (e.g., eight-ball, nine-ball, or three-ball billiards).

Figure 11:
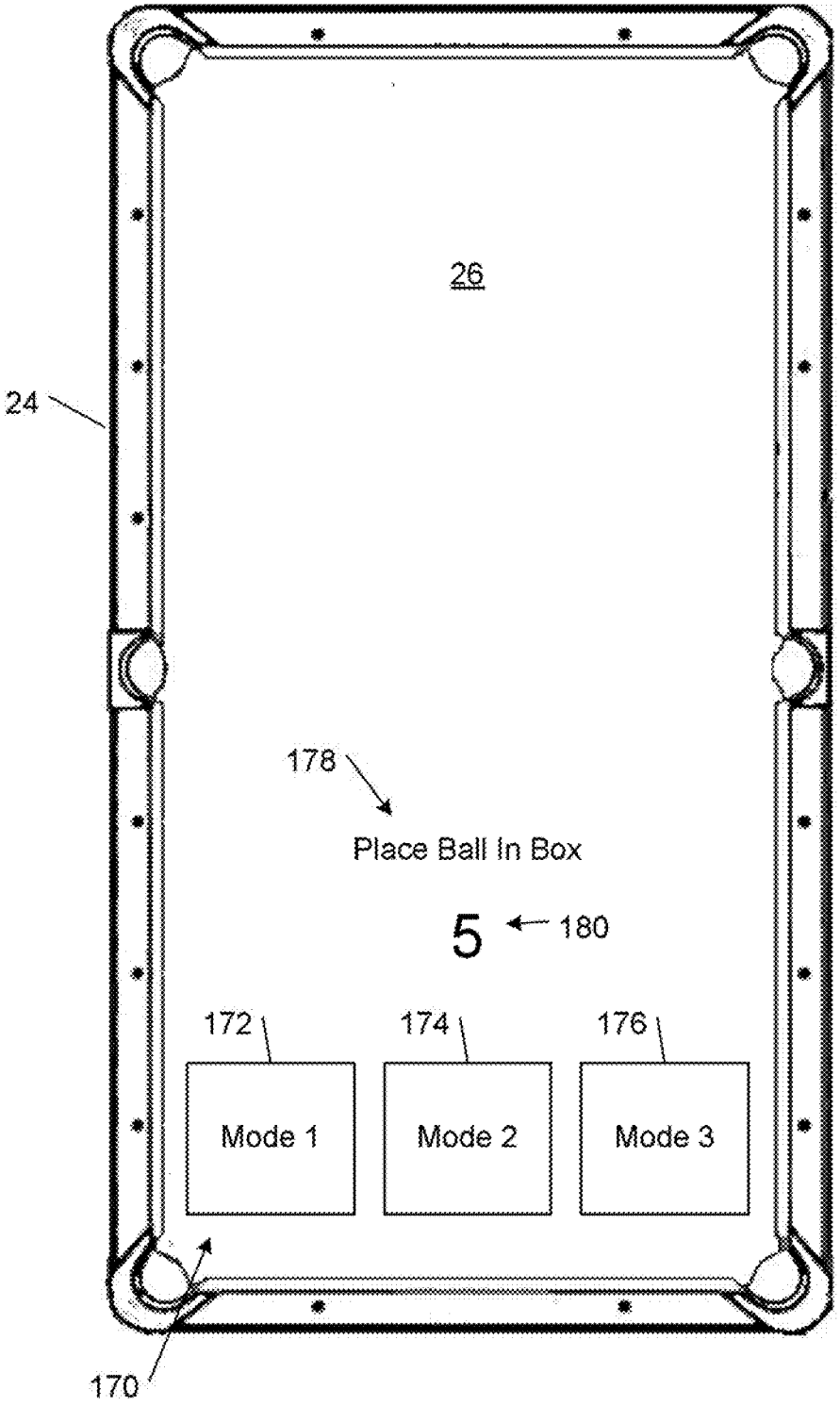
FIG. 11 is a diagrammatic view of an embodiment of user interface imagery that is displayed on a playing surface of a billiard table in accordance with an embodiment of the invention.

FIG. 11 shows an exemplary embodiment of a user interface that is displayed on the playing surface 26 of the billiard table 24. In this embodiment, the automated enhancement generation system 10 displays graphical interface imagery 170 that includes three visible interface zones 172, 174, 176 on the playing surface 26. The automated enhancement generation system 10 also displays instructions 178 ("Place Ball In Box") for using the interface and a countdown timer that indicates the amount of time before a selection of one of the interface zones 172-176 will be taken as the user's input command. The exemplary graphical interface imagery 170 typically is displayed on the playing surface 26 before the start of a billiards game.

In operation, the automated enhancement generation system 10 determines whether the determined positions of the one or more billiards game objects (e.g., one or more of billiard balls, cue stick, rack, and cue tip chalk) in relation to the displayed graphical interface imagery satisfies the input instruction predicate. The automated enhancement generation system 10 typically determines whether at least one of the billiard game objects is present in any of the interface zones 172-176. In response to a determination that the presence of the at least one billiard game object in one of the interface zones satisfies the input instruction predicate, the automated enhancement generation system 10 select an operational mode of the machine from a set of different operational modes (e.g., "Mode 1," "Mode 2," and "Mode 3"), each of which is associated with a respective one of the interface zones 172-176. Each of the operational modes may be associated with a different respective process of generating perceptible effects during a billiards game being played on the billiard table. For example, the operational modes may correspond to respective ones of the trailing, reveal, and field disturbance modes of displaying imagery described above. In some embodiments, the automated enhancement generation system 10 determines whether a billiard ball is present in any of the zones 172-176, and selects the operational mode in response to a determination that the billiard ball is present in any of the zones for a prescribed period of time (e.g., five seconds).

A visible interface zone also may be displayed during a billiards game. For example, in some embodiments, the interface zone is associated with a request for a visualization of a suggested shot. In response to a determination that the presence of the at least one billiard game object in the interface zone satisfies the input instruction predicate, the automated enhancement generation system 10 displays on the playing surface 26 a visualization of a virtual billiards shot from a current state of a billiards game being played on the billiard table.

In some embodiments, an interface zone that is associated with a request for a service may be displayed on the billiard table 24. In response to a determination that the presence of the at least one billiard game object in the interface zone satisfies the input instruction predicate, the automated enhancement generation system 10 triggers a request for the service that is associated with the interface zone. For example, in some embodiments, the service is a service for ordering an item from a menu of offerings available from a place of business in which the billiard table is situated, or from a place of business near where the billiard table is situated. In some of these embodiments, the automated enhancement generation system 10 displays a graphical representation of the menu on the billiard table 24, determines an order from a person's interactions with the displayed graphical representation of the menu, and submits the determined order to an order handling system that presents the submitted order to an employee charged with handling such an order. In some embodiments, interactions with the displayed graphical representation of the menu are performed by the user moving one or more game objects that are tracked by data processing system 14.

In general, an interface zone may be displayed in a variety of different places in the vicinity of the billiard table 24 during a billiard game. In some embodiments, the automated enhancement generation system 10 displays the interface zone at a static predetermined location on the playing surface.

In other embodiments, the automated enhancement generation system 10 predicts respective movements of one or more billiard balls on the playing surface, dynamically ascertains locations on the playing surface that avoid interference with the predicted movements of the billiard balls, and displays the interface zone on one or more of the ascertained locations of the playing surface during the billiards game. In some embodiments, the automated enhancement generation system 10 dynamically displays the interface zone on one or more locations on the billiard table adjacent one or more of the players playing a billiards game on the billiards table 24. In some of these embodiments, the automated enhancement generation system 10 automatically determines when the players are taking respective billiard ball shots, and omits the displaying of the interface zone adjacent any of the players who is ascertained to be taking a billiard ball shot. Determination of when players are taking respective billiard shots is accomplished in some embodiments by detecting the presence of at least one of a cue stick and a partial silhouette of a person above the playing surface 26. Person silhouettes are detected in some embodiments as connected pixel regions of FIG. 5, step 60, whose size is above a prescribed threshold. In other embodiments, more sophisticated methods of person silhouette detection known in the art of computer vision are applied.

In some embodiments, an interface zone is associated with a request for a visualization of one or more rules of playing a billiards game. In response to a determination that the presence of the at least one billiard ball in the interface zone satisfies the input instruction predicate, the automated enhancement generation system 10 displays one or more images depicting a visualization of the one or more game rules on the billiard table 24. The displayed images may contain text, may be static images, and may include one or more videos, or combinations thereof.

In some embodiments, the automated enhancement generation system 10 ascertains periods between billiards games, and displays imagery on the billiard table 24 during the ascertained periods. In this process, the automated enhancement generation system 10 detects an end-of-game event that is associated with a completion of a billiard game being played on the billiard table, and displays the imagery in response to a detection of the end-of-game event. In some of these embodiments, the imagery that is displayed on the billiard table during the ascertained periods includes at least one advertisement. Each advertisement may include static images, video imagery, displayed text, or any combination thereof, and may be accompanied by playing of associated audio.

IV. CONCLUSION

The embodiments that are described herein provide apparatus and methods that automatically detect game objects (e.g., billiard balls, cue sticks, a billiard rack, and cue tip chalk) and respond to the detected game objects in a way that enhances a player's experience with the game in its current context.

Other embodiments are within the scope of the claims.

The invention claimed is:

1. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, capturing images comprising the playing surface, and determining whether a static arrangement of multiple of the billiard balls detected in one or more of the captured images matches a prescribed pattern, wherein the determining comprises determining whether the static arrangement of the billiard balls matches a prescribed pattern of racked balls, and wherein the displaying comprises displaying imagery on the billiard table in response to a determination that the static arrangement matches the prescribed pattern of racked balls.

2. The method of claim 1, further comprising capturing images comprising the playing surface and detecting a billiard ball rack in one or more of the captured images; and wherein the displaying comprises displaying imagery on the billiard table in response to a detection of the billiard ball rack.

3. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, capturing images comprising the playing surface, and automatically ascertaining a type of a billiards game being played on the billiard table based on an evaluation of one or more of the captured images.

4. The method of claim 3, further comprising detecting occurrence of an event relating to the ascertained type of billiards game based on analysis of one or more of the captured images; and wherein the displaying comprises selecting event-specific imagery associated with the detected event, and displaying the selected event-specific imagery on the billiard table in response to the detection of the event.

5. The method of claim 4, wherein the detecting comprises detecting an occurrence of a rule violation event corresponding to a failure of comply with a rule of the ascertained type of billiards game based on the analysis of one or more of the captured images; and wherein the displaying comprises selecting event-specific imagery associated with the detected rule violation event, and displaying the selected event-specific imagery on the billiard table in response to the detection of the event.

6. A machine-implemented method, comprising:

by apparatus generating position data describing real-time positions of each of one or more billiard balls moving on a playing surface of a billiard table, determining whether one of the billiard balls has fallen into a pocket of the billiard table, and displaying on the playing surface imagery that dynamically responds to the position data as the one or more billiard balls move on the playing surface, wherein, in response to a determination that the billiard ball has fallen in the pocket, the displaying comprises selecting event-specific imagery associated with an event of a billiard ball falling into a pocket and displaying the selected event-specific imagery on the billiard table.

7. The method of claim 6, wherein the determining comprises determining whether a cue ball has fallen into a pocket of the billiard table, and the displaying comprises displaying on the billiard table event-specific imagery associated with a scratch event.

8. The method of claim 7, wherein, in response to a determination that the cue ball has fallen into the pocket, the displaying comprises displaying on the billiard table event-specific imagery prompting removal of the cue ball from the pocket.

9. The method of claim 7, wherein, in response to a determination that the cue ball has fallen into the pocket, the displaying comprises displaying on the billiard table event-specific imagery demarcating a region on the playing surface where the cue ball should be placed.

10. The method of claim 6, further comprising capturing images comprising the playing surface; and wherein the determining comprises determining whether one of the billiard balls has fallen into a pocket of the billiard table based on an analysis of the captured images.

11. The method of claim 6, further comprising, in each pocket of the billiard table, sensing a presence of a billiard ball and generating an associated signal indicating the presence of a billiard ball in response to a sensed presence of a billiard ball in the pocket; and wherein the determining comprises determining whether one of the billiard balls has fallen into a pocket of the billiard table based on an analysis of the signal associated with the pocket.

12. The method of claim 6, further comprising determining whether one of the billiard balls has fallen into a pocket of the billiard table, and producing an audible sound in response to a determination that the billiard ball has fallen in the pocket.

13. The method of claim 6, wherein the displaying comprises, based on the position data, displaying one or more visible dynamic artifacts trailing at least one of the billiard balls moving on the playing surface.

14. The method of claim 6, wherein the displaying comprises, based on the position data, displaying on the playing surface imagery showing a scene and local disturbances to local regions of the scene near one or more of the billiard balls moving on the playing surface.

15. The method of claim 6, wherein the displaying comprises, based on the position data, displaying on the playing surface imagery showing a scene that is visible only in regions that are revealed near positions of one or more of the billiard balls on the playing surface.

16. The method of claim 6, wherein the displaying comprises, based on the position data, displaying one or more visible artifacts connecting respective pairs of billiard balls.

17. The method of claim 6, wherein the displaying comprises, based on the position data, displaying on the playing surface a visualization of a virtual billiards shot from a current state of a billiards game being played on the billiard table.

18. The method of claim 6, further comprising detecting a collision between two or more billiard balls based on the position data; and wherein the displaying comprises displaying imagery in response to detection of the collision.

19. The method of claim 6, further comprising determining when a billiard ball contacts a bumper of the billiard table; and wherein the displaying comprises displaying a visible special effect in association with the bumper in response to a determination that a billiard ball has contacted the bumper.

20. The method of claim 6, wherein the displaying comprises, based on the position data, displaying a respective illumination around each of at least one of the one or more billiard balls on the playing surface.

21. The method of claim 6, further comprising producing an audible sound based on the position data.

22. The method of claim 21, further comprising detecting a collision between two or more billiard balls based on the position data, and the producing comprises producing an audible sound in response to detection of the collision.

23. The method of claim 21, further comprising determining when a billiard ball contacts a bumper of the billiard table based on the position data, and the producing comprises producing an audible sound in response to a determination that the billiard ball has contacted the bumper.

24. The method of claim 6, further comprising:

based on the position data, detecting an end-of-game event associated with a completion of the billiard game being played on the billiard table; and in response to the detection of the end-of-game event, displaying on the playing surface imagery relating to one or more advertisements.

25. The method of claim 6, further comprising:

based on the position data, detecting an end-of-shot event associated with an end of a shot taken on the billiard table; and in response to the detection of the end-of-shot event, displaying on the playing surface imagery relating to one or more advertisements.

26. The method of claim 6, further comprising recording a video of a billiard ball shot being taken in a billiards game that is being played on the billiards table; and wherein the displaying comprises displaying on the playing surface imagery showing a replay of the billiard ball shot based on the recorded video.

27. The method of claim 6, further comprising recording a video of a billiards game that is being played on the billiards table; and wherein the displaying comprises based on the recorded video displaying on the playing surface imagery showing a replay of a sequence of billiard ball shots that were taken during the billiards game.

28. The method of claim 6, wherein the generating comprises optically tracking the real-time positions of the one or more billiard balls on the playing surface during the displaying.

29. The method of claim 28, wherein the generating comprises capturing images comprising the playing surface, and detecting respective billiard ball regions corresponding to respective ones of the one or more billiard balls in the captured images.

30. The method of claim 29, wherein the detecting comprises generating respective gradient maps based on the captured images, and determining the respective billiard ball regions based on the gradient maps.

31. The method of claim 30, wherein the determining comprises blurring the gradient maps, thresholding the blurred gradient maps, and determining the respective billiard ball regions based on the blurred gradient maps.

32. The method of claim 31, wherein the determining comprises identifying blobs in the blurred gradient maps based on a connected components analysis of the blurred gradient maps, and classifying each of the blobs as blobs as either a billiard ball region or a non-billiard-ball region based on an evaluation of the blob.

33. The method of claim 29, wherein the generating comprises:

labeling each of the detected billiard ball regions in a first one of the captured images with a respective unique label; and matching the labeled billiard ball regions to billiard ball regions in a second one of the captured images that was captured after the first captured image was captured.

34. The method of claim 6, further comprising determining real-time velocities of each of one or more billiard balls on the playing surface.

35. The method of claim 34, wherein the displaying comprises displaying imagery that depends on the determined real-time velocities of the one or more billiard balls.

36. The method of claim 34, further comprising predicting a respective future trajectory of each of one or more billiard balls on the playing surface based on the current respective position and the current respective velocity of the billiard ball, and the displaying comprises displaying imagery on the playing surface based on the respective future trajectory of each of one or more billiard balls on the playing surface.

37. The method of claim 6, further comprising detecting a cue stick, and wherein the displaying comprises changing one or more parameters influencing visual appearance of the displayed imagery on the playing surface in response to detection of the cue stick over the playing surface.

38. The method of claim 6, further comprising detecting one or more positions of a cue stick, and wherein the displaying comprises displaying imagery based on the one or more detected positions of the cue stick.

39. The method of claim 6, further comprising capturing images comprising the playing surface and detecting occurrence of an event relating to a start of a billiards game; and wherein the displaying comprises displaying on the billiard table imagery associated with a start of a billiards game.

40. The method of claim 6, further comprising capturing images comprising the playing surface, tracking a score of a billiards game being played based on analysis of the captured images, and displaying the tracked score of the billiards game on the billiard table.

41. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, establishing a respective identity of each of one or more of the billiard balls, detecting an event involving the one or more of the billiard balls whose identities have been established, and in response to the detection of the events, producing near the billiard table a perceptible effect that depends on the established identity of each of the one or more billiard balls involved in the event;

wherein the detecting comprises detecting a start-of-game event based on the established identities of the one or more billiard balls, and in response to a detection of the start-of-game event the producing comprises producing an event-specific perceptible effect associated with a start of a billiards game.

42. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, establishing a respective identity of each of one or more of the billiard balls, detecting an event involving the one or more of the billiard balls whose identities have been established, and in response to the detection of the events, producing near the billiard table a perceptible effect that depends on the established identity of each of the one or more billiard balls involved in the event;

wherein the detecting comprises detecting a scoring event based on the established identities of the one or more billiard balls, and in response to a detection of the scoring event the producing comprises producing an event-specific perceptible effect associated with a score of a billiards game.

43. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, establishing a respective identity of each of one or more of the billiard balls, detecting an event involving the one or more of the billiard balls whose identities have been established, and in response to the detection of the events, producing near the billiard table a perceptible effect that depends on the established identity of each of the one or more billiard balls involved in the event;

wherein the detecting comprises detecting a billiard game rules violation event based on the established identities of the one or more billiard balls, and in response to a detection of the rules violation event the producing comprises producing an event-specific perceptible effect associated with a billiards game rules violation.

44. A machine-implemented method, comprising:

by apparatus generating position data describing real-time positions of each of one or more billiard balls moving on a playing surface of a billiard table, displaying on the playing surface imagery that dynamically responds to the position data as the one or more billiard balls move on the playing surface, establishing a respective identity of each of one or more of the billiard balls, detecting an event involving the one or more of the billiard balls whose identities have been established, and in response to the detection of the events, producing near the billiard table a perceptible effect that depends on the established identity of each of the one or more billiard balls involved in the event;

wherein the detecting comprises detecting an end-of-game event based on the established identities of the one or more billiard balls, and in response to a detection of the end-of-game event the producing comprises producing an event-specific perceptible effect associated with an end of a billiards game.

* * * * *